US008002688B2

(12) United States Patent
Kucera et al.

(10) Patent No.: US 8,002,688 B2
(45) Date of Patent: Aug. 23, 2011

(54) CUSTOMIZED TAB MACHINE

(75) Inventors: Mark Kucera, Howell, MI (US); Kevin Hartnett, Chatham, NJ (US)

(73) Assignee: Scott Office Systems LLC, Greensboro, NC (US)

( * ) Notice: Subject to any disclaimer, the term of this patent is extended or adjusted under 35 U.S.C. 154(b) by 144 days.

(21) Appl. No.: 12/369,977

(22) Filed: Feb. 12, 2009
(Under 37 CFR 1.47)

(65) Prior Publication Data

US 2009/0270237 A1 Oct. 29, 2009

Related U.S. Application Data

(60) Provisional application No. 61/065,457, filed on Feb. 12, 2008.

(51) Int. Cl.
*B31B 49/00* (2006.01)

(52) U.S. Cl. ..... 493/379; 493/375; 493/380; 493/381; 493/345

(58) Field of Classification Search ..... 493/374, 493/379, 380–383, 388, 393, 394, 340, 341, 493/343–347, 375
See application file for complete search history.

(56) References Cited

U.S. PATENT DOCUMENTS 3,245,859 A 4/1966 Busk
3,921,344 A * 11/1975 Goodwin ..... 451/527
4,092,817 A * 6/1978 Rist, III ..... 53/298
4,183,779 A 1/1980 Barber et al.
4,588,463 A 5/1986 Barber et al.
4,819,021 A 4/1989 Doery
4,846,774 A * 7/1989 Bell ..... 493/87
5,020,926 A 6/1991 Wilhelm
5,068,005 A * 11/1991 Lindskog et al. ..... 156/514
5,108,356 A * 4/1992 Rickenbach ..... 493/353
5,259,826 A * 11/1993 Woods ..... 493/325
5,262,834 A 11/1993 Kusaka et al.
5,401,058 A 3/1995 Holmberg
5,423,617 A 6/1995 Marsh et al.
6,191,382 B1 2/2001 Damikolas
6,435,246 B1 * 8/2002 Kerr ..... 156/553
6,463,981 B1 * 10/2002 Kerr ..... 156/555
6,569,588 B2 5/2003 Oikawa et al.
6,670,087 B2 12/2003 Fujikawa et al.
6,890,397 B1 5/2005 Weirather et al.

(Continued)

OTHER PUBLICATIONS

International Search Report, PCT/US2008/01034.

(Continued)

*Primary Examiner* — Christopher Harmon
(74) *Attorney, Agent, or Firm* — Lerner, David, Littenberg, Krumholz & Mentlik, LLP

(57) ABSTRACT

Disclosed is a tabbed divider making apparatus preferably adapted for use with smaller, more individualized jobs in an office or the like. The apparatus preferably includes a paper feeder, a film provider, a knife package for shearing a portion of the paper to create a tab, at least one strut, a pivotable arm, at least one spring, and a cam having an oblong shape. The rotation of the cam preferably causes movement between loaded and unloaded positions of the spring, which causes the knife package to shear the paper. Also disclosed is a removable film cartridge for use with the apparatus. The cartridge preferably includes a housing, a roll of film, one or more rollers, a creasing finger for creasing the film, and two or more opposed extensions for folding the film along the crease. Further disclosed is a method of producing a tabbed divider utilizing the above-mentioned apparatus.

23 Claims, 33 Drawing Sheets

U.S. PATENT DOCUMENTS

| | | | |
|---|---|---|---|
| 7,588,066 | B2 | 9/2009 | Parker et al. |
| 2006/0191426 | A1 | 8/2006 | Timmerman et al. |
| 2011/0065562 | A1 | 3/2011 | Kucera et al. |

OTHER PUBLICATIONS

Advent, advertisement, Oct. 1993.
Advent, Internet advertisement, Jan. 2001.
Halm, Super Jet Brochure, date unknown.
Binding Supplies, Tabcutter Brochure, date unknown.
Autofeeds, Titan Tabber Brochure, Aug. 2001.
Widman, Product Brochure, date unknown.
E-Z Machine Corp, General Product Brochure, date unknown.
E-Z Machine Corp, Laminator and Tab-Cutter Flyer, date unknown.
Advent, Brochure, date unknown.
Scott Office Systems, RHP 7000 Brochure, date unknown.
The Scott Ten Thousand Brochure, date unknown.
Scotty 5000 Brochure, date unknown.
Scott Brochure for Certain Manual Machines, date unknown.
Scott Office Systems, Brochure, Oct. 2007.
International Search Report, PCT/US2009/00955.

* cited by examiner

CUSTOMIZED TAB MACHINE

CROSS-REFERENCE TO RELATED APPLICATIONS

This application claims the benefit of the filing date of U.S. Provisional Patent Application No. 61/065,457 filed Feb. 12, 2008 and entitled "CUSTOMIZED TAB MACHINE," the disclosure of which is hereby incorporated herein by reference.

BACKGROUND OF THE INVENTION

The present invention relates to apparatus and methods for providing paper stock with tabs, and more particularly, to a tab making machine suited for use for smaller, more individualized, jobs in an office or the like.

Tabbed dividers are often utilized in separating sections of binders, presentations, etc. Typically, these tabbed dividers are thickened pieces of paper stock having a tab extending a distance at least slightly beyond that of normal paper length or width for ease of access to different sections of a multi-section document/presentation. Whether punched with holes or utilized with file folders, such tabbed dividers are important in organizing documents and other papers. With the emergence of easy in-house printing and copying and the use of presentation software such as Microsoft® PowerPoint®, the use of such dividers has only increased. Many businesses make use of tabbed dividers on a regular basis, and must therefore have hundreds or even thousands of such dividers on hand. Some may include pre-printed tab portions for particular uses, while others may be generic labels or are simply left blank. No matter what types of tabbed dividers are utilized, their usefulness is evident and such are constantly in demand.

However, with the advent of more self-sufficient offices/businesses comes the need for more personalized or specifically tailored tabs. For example, rather than utilizing generic or blank tabbed dividers, businesses may desire tabs with printing specifically related to their end use. Ordering these customized tabbed dividers from a standard tabbed divider manufacturer can be costly. This is especially true if only a small amount of dividers is required.

The general operation of a known tab making apparatus includes feeding paper stock or other suitable material to a shearing or other cutting apparatus. This step is typically mechanically performed through the use of a series of rollers. Once in position, a portion of the paper stock is sheared to create one or more tab portions. These tab portion(s) may be laminated before cutting in order to provide protection and a more finished look. This is generally done by a single machine, millions of times, to produce millions of tabbed dividers. Stopping and programming such a machine to produce a relatively small amount of customized dividers necessarily lowers the overall efficiency of same. This is, of course, reflected in the cost of the customized dividers.

Therefore, there exists a need for a tab making machine suited for use for performing smaller, more individualized jobs, such as the ready production of customized tabbed dividers.

SUMMARY OF THE INVENTION

A first aspect of the present invention is a tabbed divider making apparatus capable of making tabbed dividers from at least one sheet of paper. The apparatus preferably includes a feeder for providing at least one sheet of paper to the apparatus, a film provider for providing film to the at least one sheet of paper traveling through the apparatus, a knife package for shearing a portion of the at least one sheet of paper to create a tab, at least one strut attached to the knife package, a pivotable arm attached to the at least one strut, at least one spring attached to the pivotable arm, the at least one spring having a loaded position and an unloaded position, and a cam having an oblong shape, wherein rotation of the cam causes movement of the at least one spring between the loaded position and the unloaded position and movement of the at least one spring from the loaded position to the unloaded position causes the knife package to shear the portion of the at least one sheet of paper.

In accordance with certain embodiments of this first aspect, the apparatus may further include at least two opposed rollers configured to pull a sheet of paper from the feeder. The at least two opposed rollers may each have a rubber outer portion. The apparatus may further include a film shearing portion having at least one spring and a punch actuated by the at least one spring. In all cases, the film is preferably cut by the tip die. The apparatus may further include a projection to align the film prior to its being cut by the tip die. The film provider may include a roll of film or a removable cartridge having a roll of film. The cartridge may include a housing having an opening through which the film is passed to the film shearing portion, one or more rollers disposed within the housing for advancing the film, a creasing finger disposed within the housing for providing a crease in the film, and two or more opposed extensions disposed within the housing for folding the film along the crease. In other embodiments of this first aspect, the apparatus may include a laminating portion having at least one heated roller that may be capable of at least partially melting the film. The at least one heated roller may include an outer rubber coating and a heating core. The at least one heated roller may rotate with respect to the apparatus while the heating core does not rotate with respect to the apparatus. In still other embodiments, the apparatus may include two springs and two struts, an aluminum frame, and/or an output tray. The knife package may include a standard shear and a cut-out corresponding to the dimensions of a tab. The apparatus may further include a printer, which may be an ink jet printer.

A second aspect of the present invention is a method of producing a tabbed divider. This method may include the steps of feeding a sheet of paper into a tabbed divider making apparatus, providing at least a portion of the sheet of paper with film, at least partially laminating the film onto the sheet of paper, shearing a portion of the laminated sheet of paper to create a tabbed divider, the sheering step including rotating a cam having an oblong shape to cause first and second movements of an arm, the first movement of the arm causing loading of at least one spring and the second movement of the arm allowing for unloading of the at least one spring, the unloading forcing a knife package to shear the portion of the laminated sheet of paper, and outputting the tabbed divider from the apparatus.

In accordance with certain embodiments of this second aspect, the step of shearing may include loading and unloading at least two springs. The step of providing may include shearing a portion of the film and providing the sheared portion of film to the sheet of paper. The method may further include folding the film prior to shearing a portion thereof. The step of providing may include providing the film from a roll of film or providing the film from a cartridge having a roll of film. The method may further include printing on at least a portion of the sheet of paper. The step of printing may be performed by an ink jet printer. The step of printing may include printing on at least a portion of the laminated portion of the sheet of paper. The step of laminating may be performed by at least one heated roller.

A third aspect of the present invention is a removable film cartridge for use with a tabbed divider making apparatus. The cartridge preferably includes a housing having an opening through which the film is passed to the tabbed divider making apparatus, a roll of film disposed within the housing, one or more rollers disposed within the housing for advancing the film, a creasing finger disposed within the housing for providing a crease in the film, and two or more opposed extensions disposed within the housing for folding the film along the crease.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

Figure 1A:
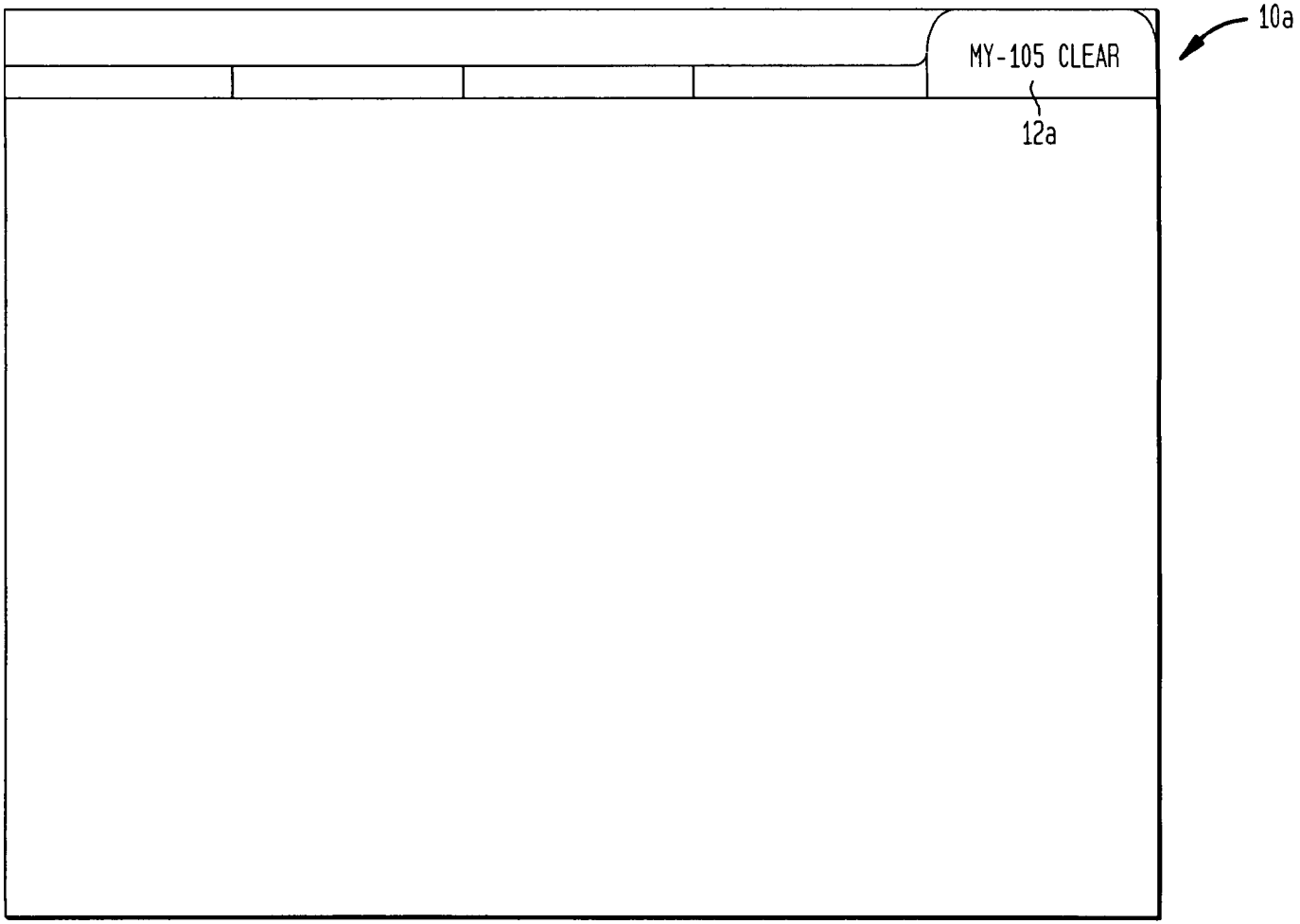
FIGS. 1A-1E are plan views of exemplary tabbed dividers having differently positioned tab portions.
Figure 1B:
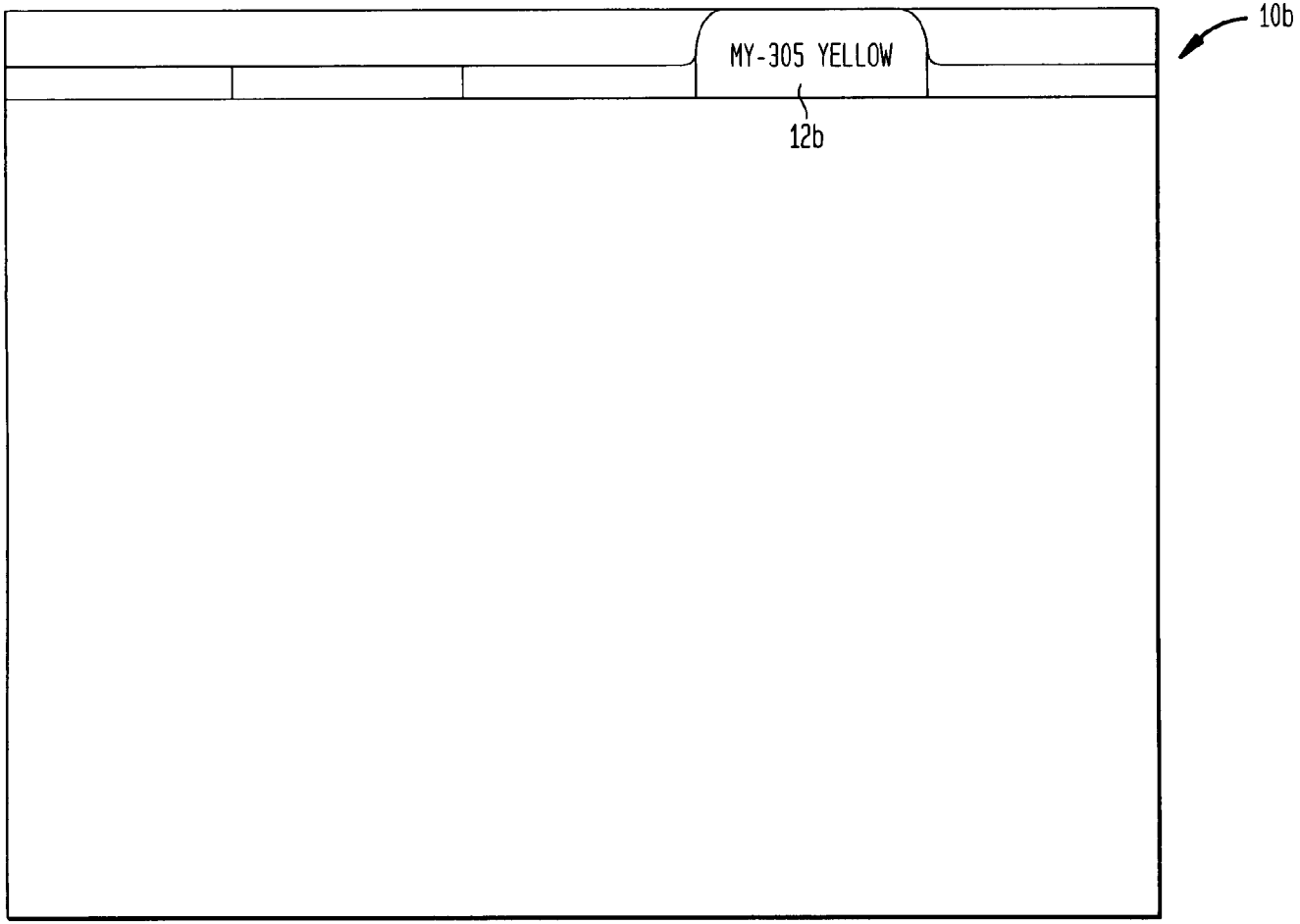
Figure 1C:
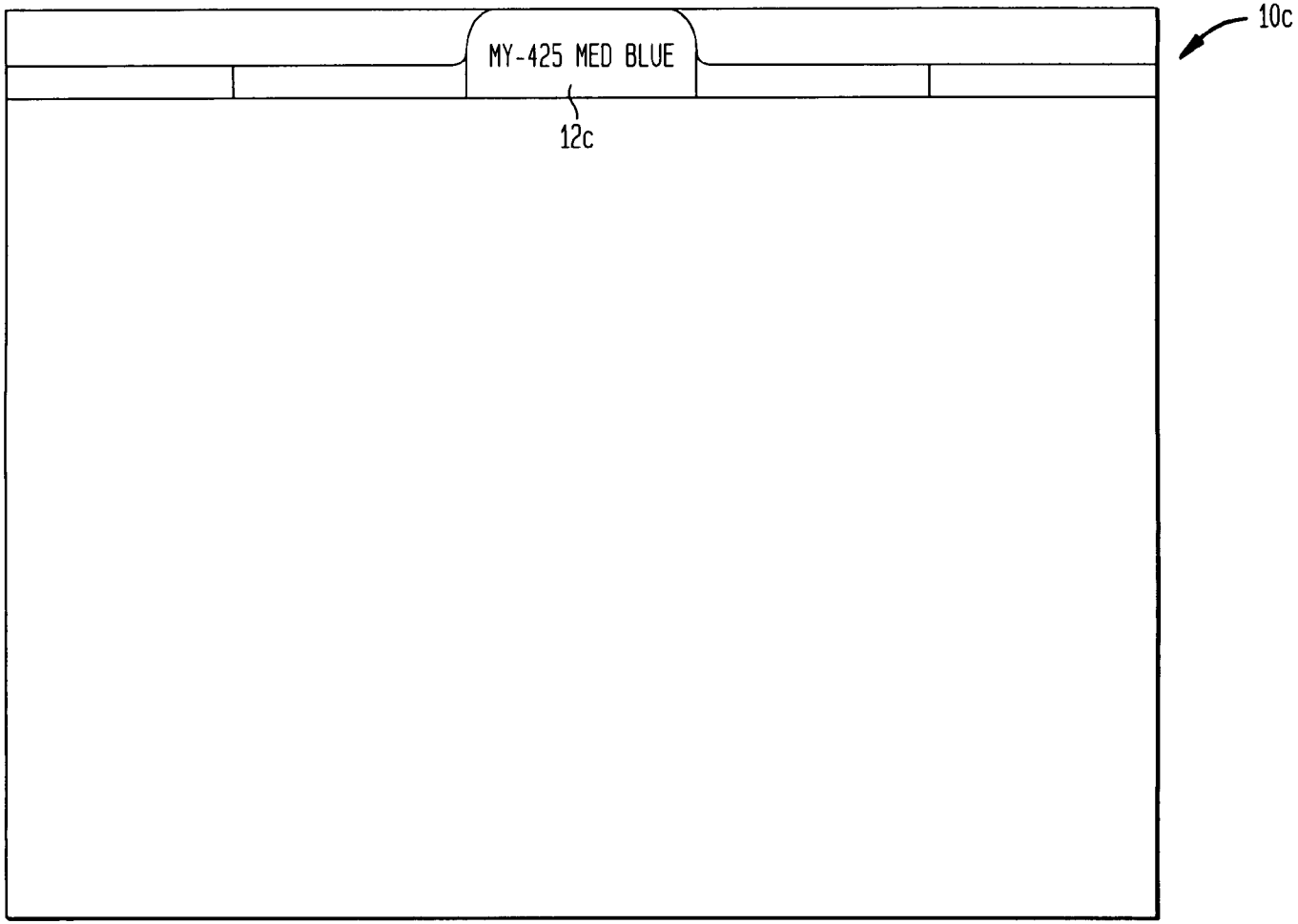
Figure 1D:
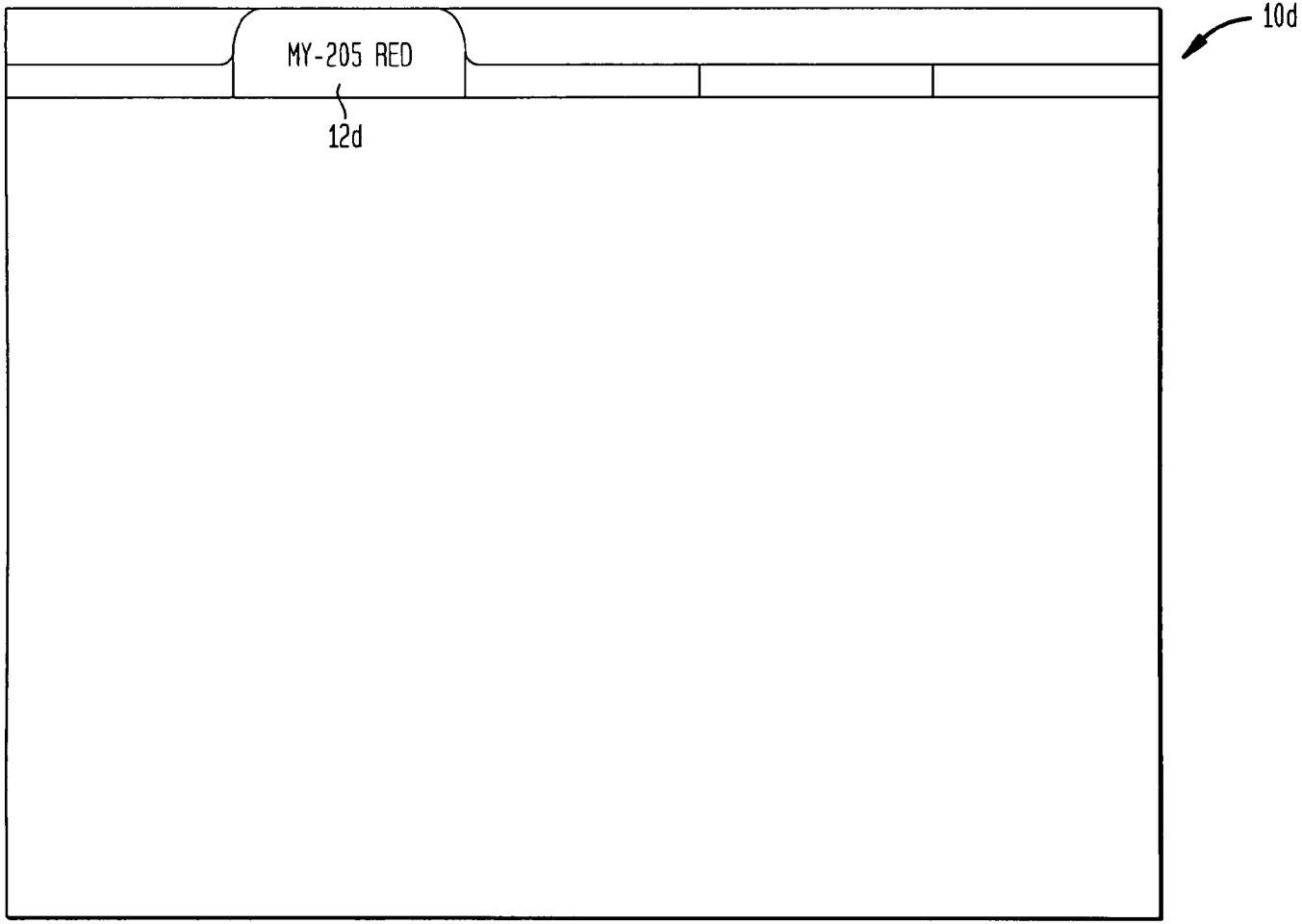
Figure 1E:
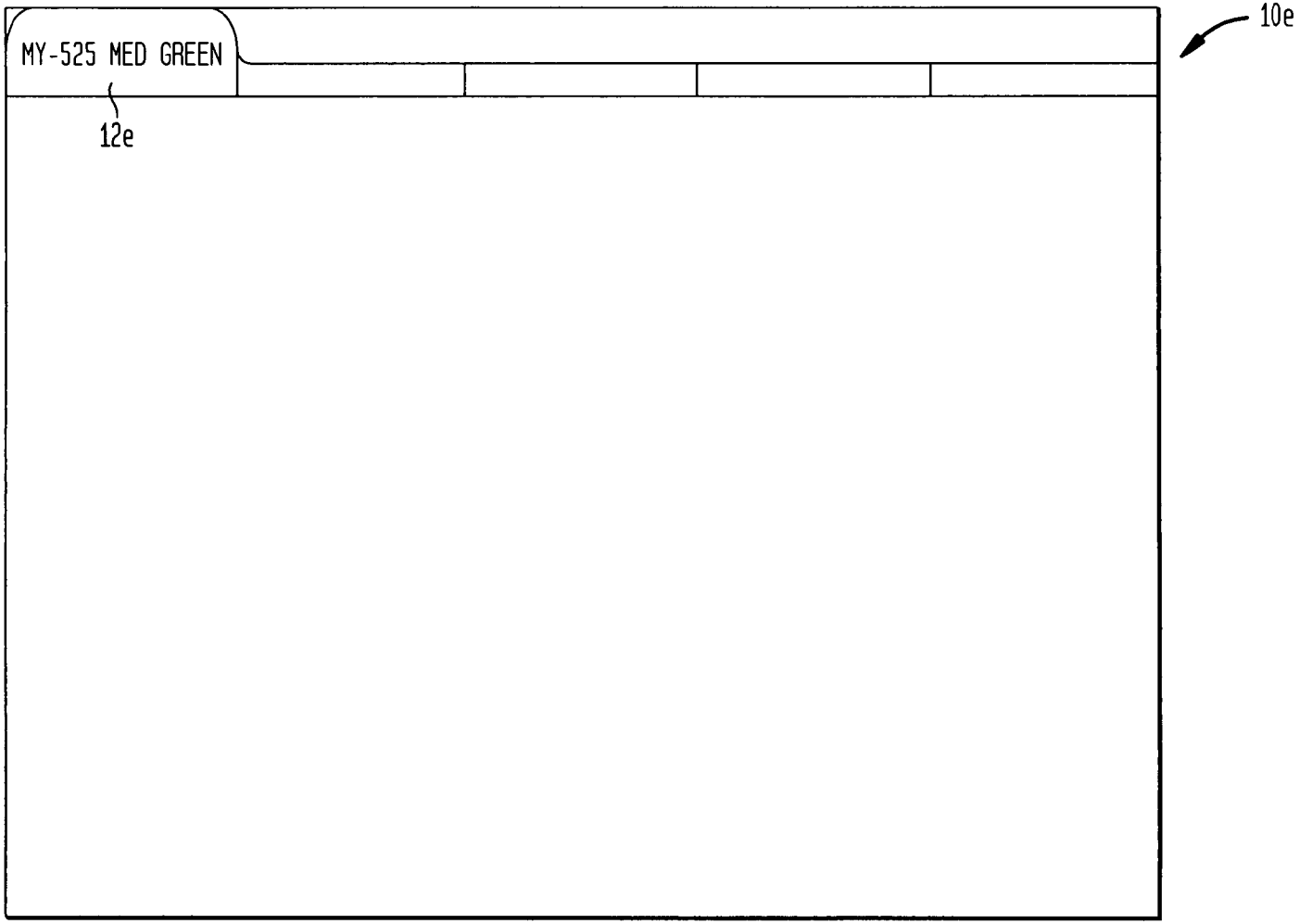

Referring to the drawings, wherein like reference numerals refer to like elements, FIGS. 1A-1E depict a set of exemplary tabbed dividers 10*a*-10*e*, having tabs 12*a*-12*e*, respectively. Each divider is constructed from a single sheet of paper stock with certain portions (i.e., tabs 12*a*-12*e*) being laminated. Divider 10*a* includes tab 12*a* in a first position, divider 10*b* includes tab 12*b* in a second position, divider 10*c* includes tab 12*c* in a third position, divider 10*d* includes tab 12*d* in a fourth position, and divider 10*e* includes tab 12*e* in a fifth position. In addition, each tab 12*a*-12*e* is provided with a different color and label. As would be readily apparent to those of ordinary skill in the art, use of such dividers 10*a*-10*e* would essentially involve separating different sections of a document, a presentation or the like with a different divider placed in front of each section. For example, in a three ring binder, dividers 10*a*-10*e* would be punched with holes, preferably opposite the tabbed portions, and placed in the binder so as to separate five different sections of materials housed therein. Should a sixth or further section be required, another divider 10*a* would be employed after divider 10*e*, and so on and so forth.

It is to be understood that dividers 10*a*-10*e* are merely one example of a set of dividers, and there are many different divider configurations that can be used. For instance, dividers with smaller or a greater number of tabs may be provided, and thus, a larger set can be provided. In addition, the size and shape of both the dividers themselves, as well as the tabs, may vary. Likewise, different materials may be utilized in constructing the dividers, such as can differently colored paper and/or lamination for the tabs. Whatever the case, the present invention can be utilized to create sets of dividers like dividers 10*a*-10*e*, and variations of same.

FIGS. 2-14 show a preferred embodiment of a customized tabbed divider making apparatus or machine, designated generally with reference number 20. Machine 20 is shown throughout FIGS. 2-14 in a partially constructed state, and it is to be understood that additional components may be included in or on machine 20, or machine 20 could be part of a larger scheme of equipment. Machine 20 produces identically or substantially similarly configured tabbed dividers as other known and previously utilized tabbed divider making apparatus, but is particularly suited for an in-house use, such as in an office setting or the like. For instance, machine 20 operates so as to manufacture tabbed dividers much like those produced by the tabbed divider making apparatus disclosed in commonly owned U.S. Provisional Application Nos. 60/898,830 ("the '830 provisional") and 60/904,561 ("the '561 provisional"), and U.S. patent application Ser. No. 12/009,828 ("the '828 application"), the disclosures of which are hereby incorporated by reference herein. The machines of the '830 and '561 provisionals and the '828 application are suited for the output of a voluminous amount of tabbed dividers in a manufacturing setting. While the machines differ somewhat in operation, machine 20 of the present application and the machines disclosed in the '830 and '561 provisionals and the '828 application have certain common operational features. Generally, the differences between these machines result from the desire for the present invention to be more suited for an office-like setting. Nonetheless, the present invention may be capable of incorporating certain of the more salient features of prior art tabbed divider making apparatus, such as the machines of the '830 and '561 provisionals and the '828 application. This will be discussed more fully below.

Turning now to the construction of the present invention, machine 20 preferably includes a carriage 22 that essentially serves as the support structure for all of the other components associated with machine 20 and shown in the figures. Carriage 22 is preferably constructed of a light weight, sturdy material, such as aluminum. This provides the necessary stability to machine 20, while also allowing same to be relatively light in weight and somewhat portable. Other materials may also be employed, such as certain sturdy polymers. Carriage 22 preferably situates the remaining components of machine 20 such that paper stock can be fed into machine 20, laminated with a film material, processed to include a tab, and output as a finished tabbed divider. In addition, machine 20 may be provided with a printer or the like in order to produce tabs having customized indicia set forth thereon. This latter aspect will be discussed more fully below where the various components of machine 20 are discussed with regard to its operation.

Figure 2:
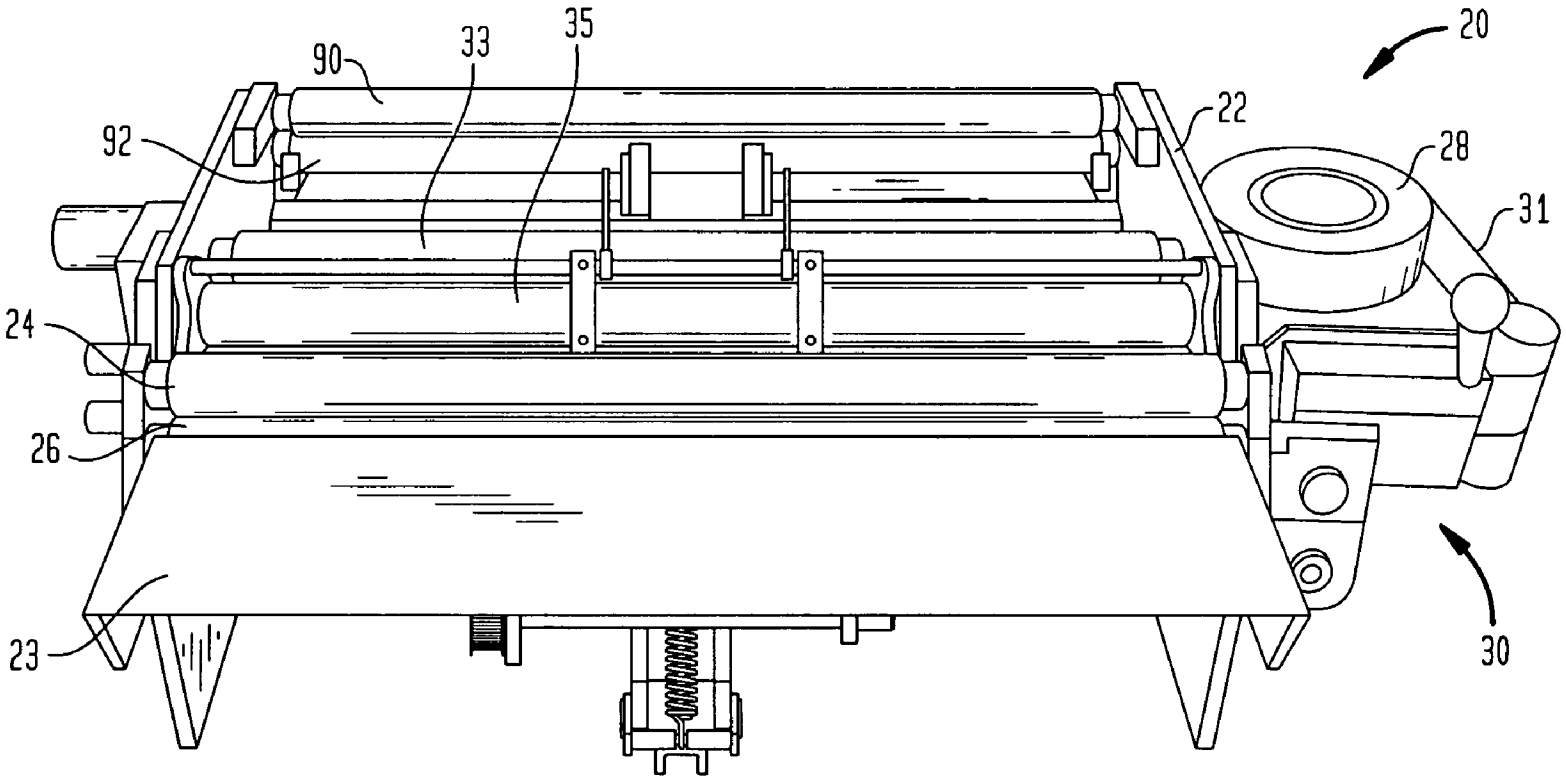
FIG. 2 is a front perspective view of one embodiment tabbed divider making apparatus in accordance with the present invention.

First, paper stock, such as that which is utilized in making dividers 10*a*-10*e*, is preferably fed into machine 20. Although not shown in the figures, machine 20 may include an automated paper feeder capable of feeding individual sheets of paper stock to machine 20 from a reserve of paper stock. The overall size of machine 20 may dictate how much paper stock can be stored in this reserve. One example of a suitable paper feeder is taught in the '830 provisional and the '828 application. However, such would have to be tailored to the particular configuration of the present invention, i.e., a smaller scaled machine. As is best shown in FIG. 2, machine 20 includes a simple platform 23 for holding one or more sheets of paper. This is a paper feeder in its simplest form, and may require feeding individual sheets one at a time by a user.

Machine 20 may be provided with a printer or other marking device (not shown) for printing or etching on a section of the paper stock, such as the portion which will become the tab. The inclusion of such a component would allow for customized/personalized tabs to be made for the dividers. Those of ordinary skill in the art would recognize those devices capable of performing such a function. However, such may have to be modified or otherwise tailored for use with the present invention. It is also to be understood that this printer or the like could be incorporated into machine 20 so that it performs its function at another point during the operation, such as subsequent to laminating the tab portion, where the printing would be done over the lamination. An example of a suitable printer is discussed further below in reference to FIGS. 19 and 20.

Platform 23, or alternatively the aforementioned paper feeder (not shown), preferably allows individual sheets of paper stock to be fed between rollers 24 and 26. Rollers 24 and 26 are preferably situated in an opposed relationship and caused to rotate in opposite directions to one another. In the design shown in the figures, rollers 24 and 26 are situated so as to grab paper from platform 23, and are preferably rotated so that paper stock is pulled from the paper feeder and towards the remaining portions of machine 20. Rollers 24 and 26 are preferably constructed of a solid core surrounded by a pliable material, such as rubber, but others designs may also be employed. The use of a pliable material allows for a certain amount of give between the surfaces of opposed rollers 24 and 26, so as to allow for an unimpeded flow of paper stock therebetween. Prior art devices have traditionally utilized floating rollers having a spring bias or the like to achieve this give or cushioning, thusly preventing the paper stock from binding. Although these prior art designs could be used in conjunction with machine 20, the particular design of rollers 24 and 26 are preferably utilized in order to reduce the overall size of machine 20.

Just subsequent to being pulled into machine 20 by rollers 24 and 26, one edge of the sheet of paper stock is fed into a section of machine 20 in which the sheet is provided with a material, such as a film 31, that is ultimately laminated onto a portion of the paper stock (i.e., the portion used to create the tab). As is shown in FIGS. 2-7, film 31 is provided from a roll of film 28 that is fed through a film director 30 (best shown in FIGS. 4 and 5), through a tube or channel 32 (best shown in FIG. 4), and ultimately to a film shearing portion 34 (best shown in FIG. 6). It is to be understood that additional or alternative components may be employed in the process of providing film to each individual sheet of paper stock. For example, a film cartridge may be included in machine 20, in lieu of roll 28. This cartridge may be designed to deliver a constant stream of film 31, like the cartridges discussed in the '830 provisional, or could be designed to deliver pre-sized individual portions of film 31. In the case of the latter, machine 20 would not necessarily require any of the below-discussed film shearing or cutting mechanisms. An example of a cartridge for use in film delivery is discussed further below.

Figure 3:
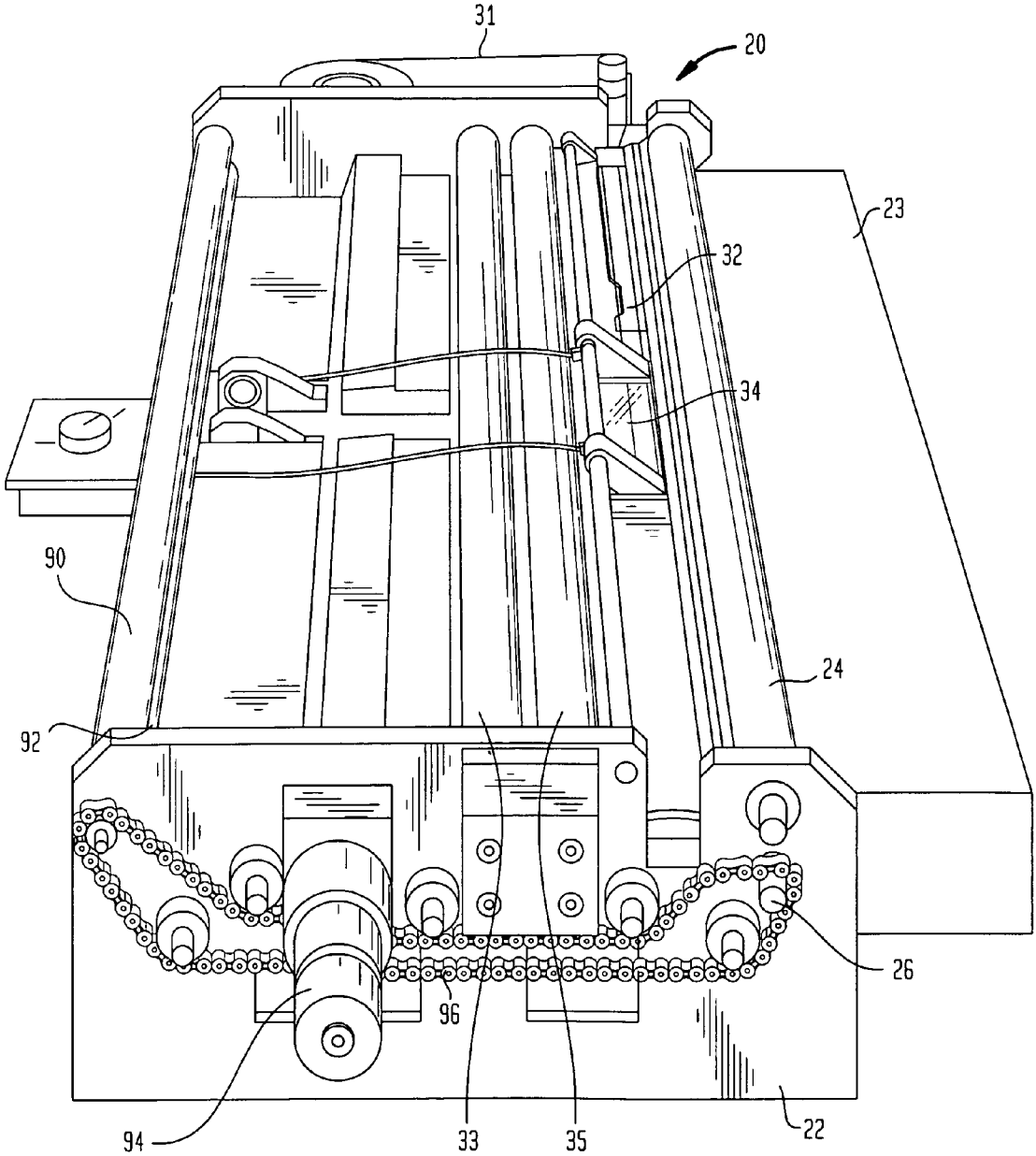
FIG. 3 is a left side perspective view of the tabbed divider making apparatus shown in FIG. 2.
Figure 4:
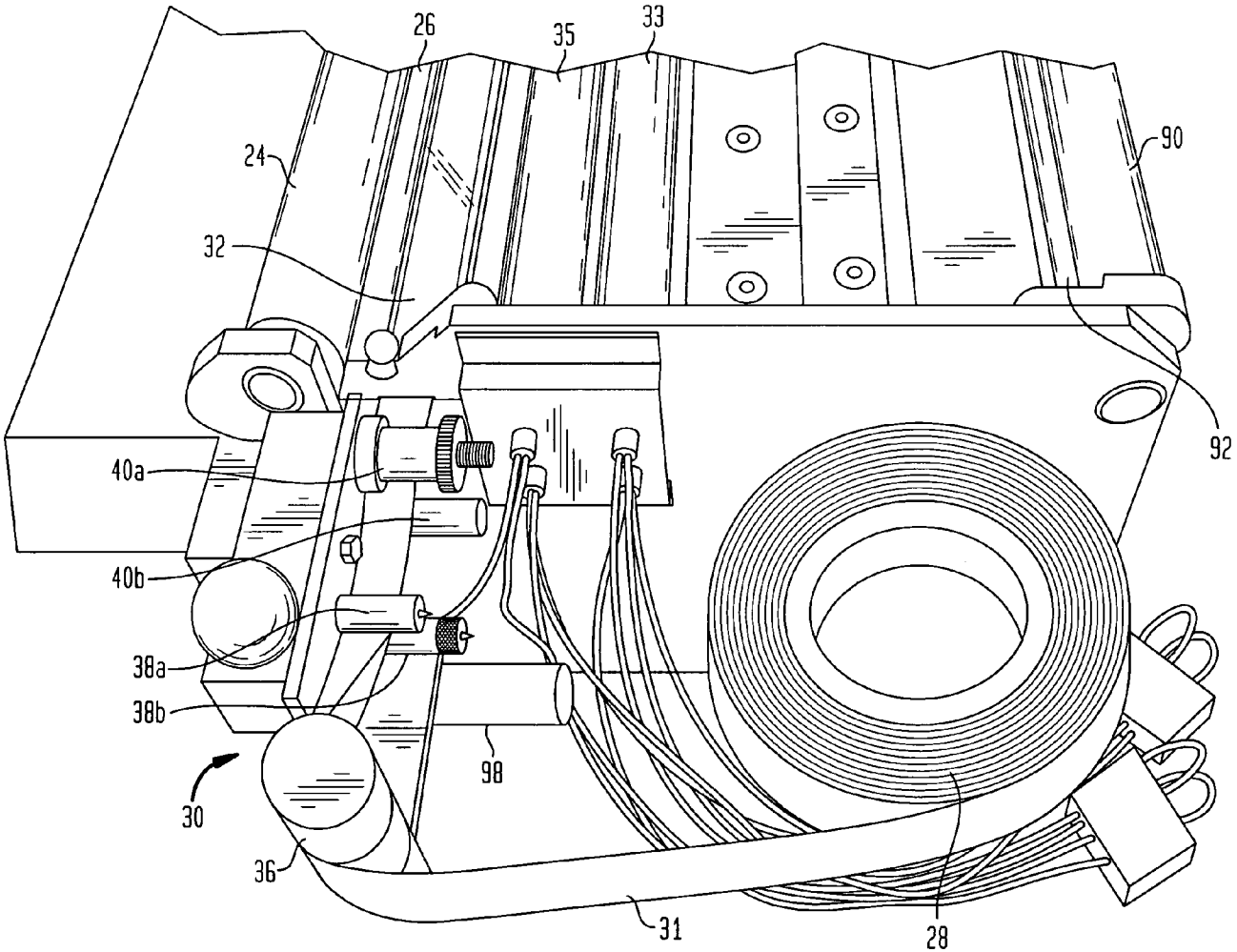
FIG. 4 is a right side partial perspective view of the tabbed divider making apparatus shown in FIG. 2.

In the embodiment shown in FIGS. 2-14, roll 28 is a cylindrical roll of film 31 that is preferably disposed on a structure such that film 31 can easily be pulled and unwound from the roll. Film 31 is preferably pulled from roll 28 under the power of pullers 40*a* and 40*b*, which rotate in opposite directions from one another and are situated between extensions 38*a* and 38*b* and channel 32. These pullers are preferably powered by a motor or the like, or may be mechanically linked to other powered components of machine 20. The unwound film 31 is then fed through director 30, which essentially orients film 31 in a direction suitable for travel through tube or channel 32. Specifically, as is best shown in FIG. 4, director 30 includes a vertically oriented roller 36 and a pair of horizontally oriented extensions 38*a* and 38*b* that operate in combination to redirect the flow of film 31 from roll 28 into channel 32.

Film 31 is folded as it travels through director 30. Specifically, after film 31 passes around roller 36, the outer edges of film 31 are directed towards one another such that film 31 is essentially folded in half. The folded film 31 then passes through extensions 38*a* and 38*b*, through channel 32, and ultimately into engagement with the sheet of paper stock that has been fed into machine 20. At least a portion of the paper stock is therefore provided with some film 31 on both its top and bottom portions, as is typical of fully formed tabs.

Once film 31 enters into channel 32, pullers 40*a* and 40*b* continue to advance film 31 toward shearing portion 34, which includes a punch 50 between a sealed area 46 and an open area 48. Beneath sealed area 46 is a first die and beneath open area 48 is a second die. Punch 50 includes a wide portion 50*a* and a narrow portion 50*b*, and the width of each of these portions substantially coincides with the dimensions of the space between the first and second dies. Therefore, when film 31 is disposed beneath punch 50, film 31 is punched or sheared as punch 50 passes between the first and second dies, resulting in a small portion of film 31, often termed a slug, being discarded. Just prior to reaching punch 50, film 31 preferably engages a finger or projection 42 (best shown in FIG. 6) that extends into a cut out 44 in channel 32. This projection 42 ensures that the folded film is aligned in a position suitable for engagement with one edge of the paper stock. After it engages projection 42, film 31 is fed into film shearing portion 34. Although it is shown in the figures that open area 48 is positioned downstream of sealed area 46 with respect to the direction in which film 31 travels, it is to be understood that the positions of sealed area 46 and open area 48 could be reversed.

The folded film 31 is preferably fed until at least a portion thereof extends into open area 48. At this point, punch 50 is operated to shear the downstream portion of film 31 from the remaining stream that is still attached to roll 28. This shearing operation will be described further below. An edge of the sheet of paper stock fed into machine 20 by rollers 24 and 26 is preferably allowed to engage the sheared film 31 such that one portion of the folded film 31 is disposed on a top side of the sheet and the other portion of the folded film 31 is disposed on a bottom side of the sheet. This will ultimately result in a tab with lamination on both of its sides.

Figure 7A:
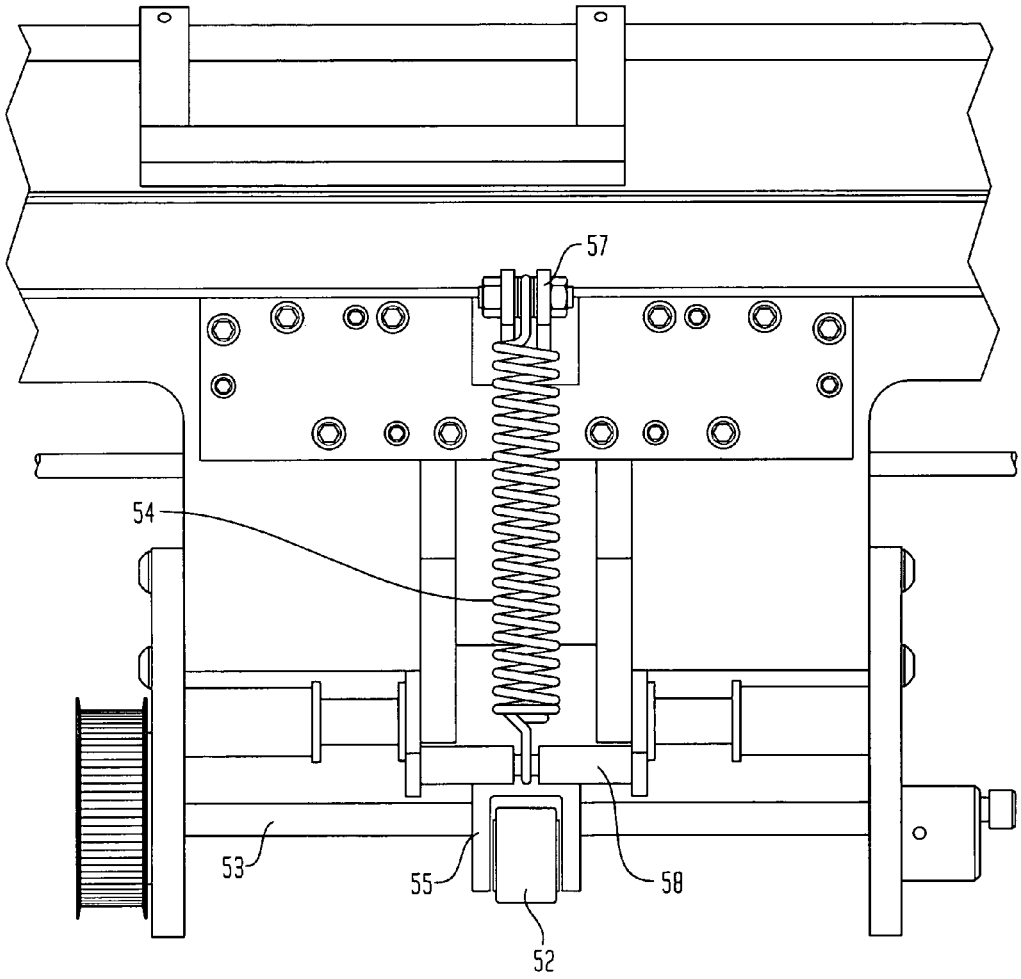
FIGS. 7A-7C are enlarged views of a punch actuator portion of the tabbed divider making apparatus shown in FIG. 2.
Figure 7B:
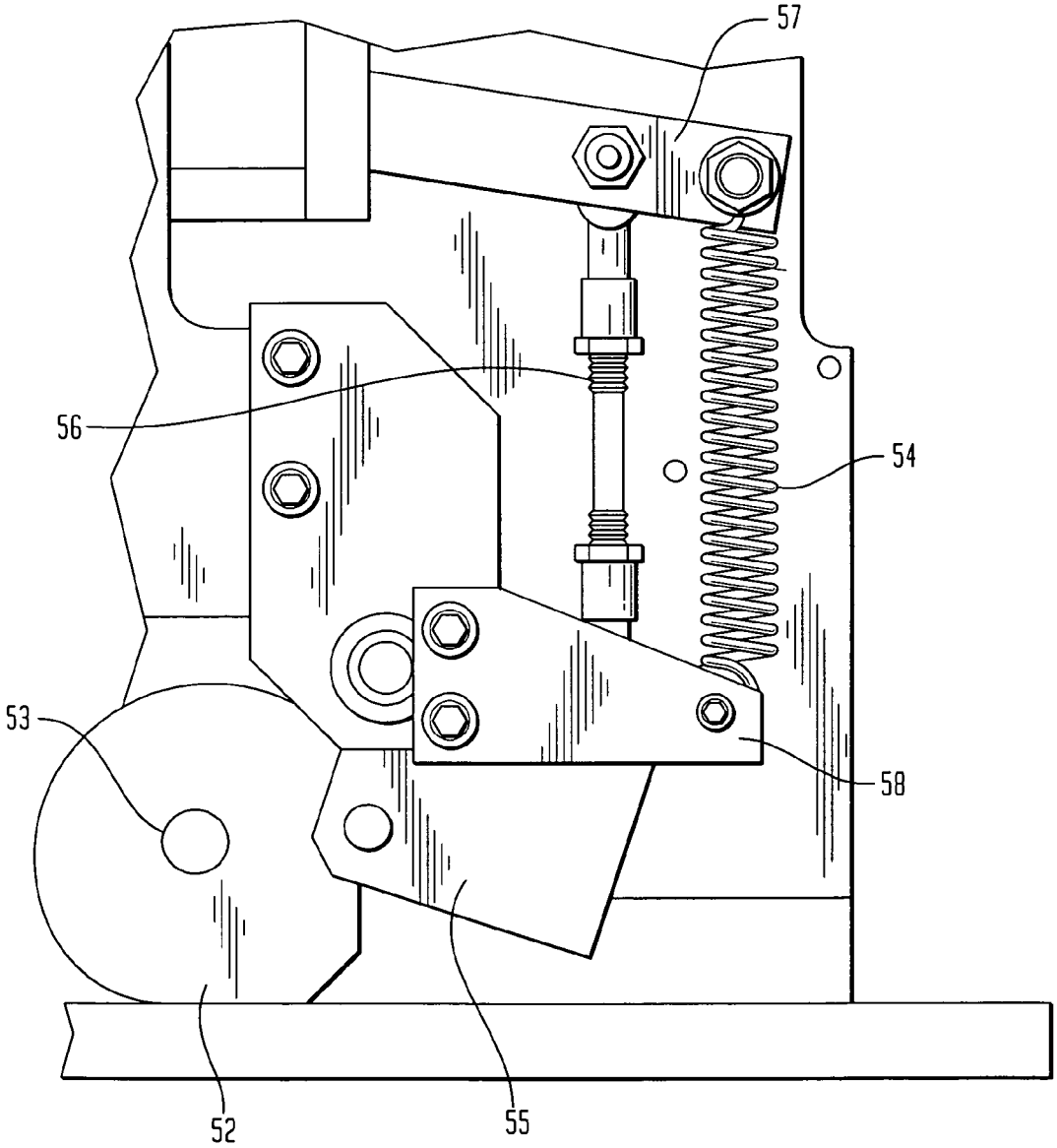
Figure 7C:
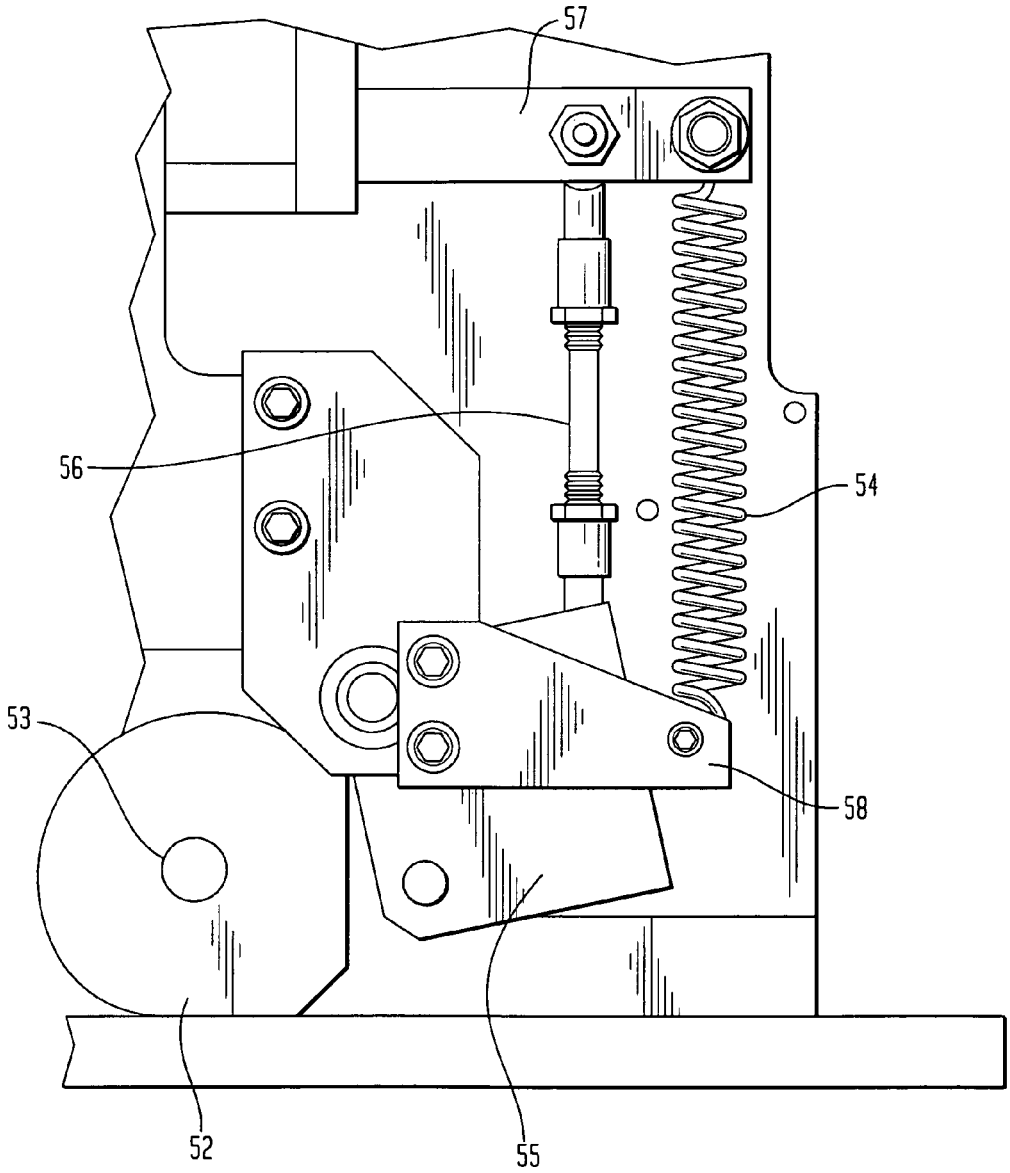

FIGS. 7A-C show the mechanism which causes punch 50 to shear film 31 fed into open area 48. This mechanism is preferably located on a front portion of machine 20. Much like the below-discussed operation of the knife package, which is preferably located on a rear portion of machine 20, operation of punch 50 is primarily due to the mechanical relationship between a cam 52 and a spring 54. More particularly, as is best shown in FIGS. 7B and 7C, cam 52 has an oblong shape and a circumference having a round portion and a flat portion. The round portion of cam 52 may be of constant radius or of varying radius, such as an increasing radius. Cam 52 is fixedly connected to an axle 53 that may be rotated by another portion of machine 20, or alternatively by the larger scheme of equipment with which machine 20 may be associated. Throughout its rotation, the circumference of cam 52 comes into contact with a pivotable body 55, which is connected by a strut 56 to an arm 57. Thus, the movement of pivotable body 55 is translated through strut 56 into movement of arm 57.

Arm 57 includes an exposed portion and an internal portion (not shown). The exposed portion of arm 57 is that which is seen in the figures, particularly in FIGS. 7A-7C. The movement of arm 57 is defined by a hinge or pivot point (not shown due to its internal positioning in machine 20) disposed between the exposed and internal portions of arm 57. Punch 50 is similarly pivotable in that it is coupled to a punch shaft (also not shown due to its internal positioning in machine 20) that runs through wide portion 50*a* of punch 50 and along the direction of channel 32. The internal portion of arm 57 is mechanically connected with wide portion 50*a* of punch 50 and causes punch 50 to rotate about the punch shaft. When pivotable body 55 forces strut 56 upward, the exposed portion of arm 57 moves upward and arm 57 rotates accordingly about the hinge or pivot point, which in turn causes the internal portion of arm 57 to move downward. This downward movement of the internal portion of arm 57 rotates punch 50 such that narrow portion 50*b* of punch 50 is rotated upward and away from film 31 and the first and second dies. This is said to be an open configuration of punch 50. Vice versa, when the internal portion of arm 57 is caused to move upward, narrow portion 50*b* of punch 50 rotates downward toward the first and second dies and contacts film 31. This is said to be a closed configuration of punch 50. Therefore, arm 57 ultimately controls punch 50 and causes punch 50 to cut or shear film 31.

Spring 54 is connected at one end to a fixed body 58 and at the other end to the exposed portion of the moveable arm 57. Spring 54 is biased such that it tends to pull the exposed portion of arm 57 toward fixed body 58. FIGS. 7A and 7C show spring 54 in a loaded state, while FIG. 7B shows spring 54 in an unloaded state. Contact of the rounded surface of cam 52 with pivotable body 55 causes strut 56, and therefore the exposed portion of arm 57 with which it is connected, to be moved upward. Spring 54, in turn, is caused to become elongate and thusly loaded with a force. The result of this mechanical configuration is that spring 54 forces pivotable body 55 to maintain contact with cam 52. When the flat portion of cam 52 rotates into contact with pivotable body 55, pivotable body 55 is able to pivot in a direction toward axle 53. Through the above described mechanical connections, this allows spring 54 to become unloaded, forcing the exposed portion of arm 57 and strut 56 to drop suddenly. This sudden movement causes the internal portion of arm 57 to rise, thereby causing punch 50 to shear film 31 passing through shearing portion 34. Of course, rotation of axle 53 and cam 52 can be timed with the feeding of film 31 such that punch 50 operates only when film 31 is in position to be sheared.

The configuration of machine 20 is such that when the exposed portion of arm 57 drops in a sudden movement due to the unloading of spring 54, this sudden movement is translated to the sudden closing of punch 50 and the shearing of film 31. Of course, other variations of the mechanical connections of the above-described components of machine 20 are also possible to achieve the same or similar results, and such would be understood by one of ordinary skill in the art.

As would further be understood by one of ordinary skill in the art, the distance between the axis of axle 53 and the various portions of the circumference of cam 52 can be tailored according to the intended operation of punch 50. This distance is also understood to be the radius of cam 52. The radius of cam 52 throughout its rounded portion may increase as cam 52 is rotated, which would cause the exposed portion of arm 57 to continually move upward and open punch 50. Alternatively, the radius of cam 52 along its rounded portion may be constant such that the space between punch 50 and the first and second dies remains constant. Accordingly, the transition between the rounded portion and the flat portion of cam 52 dictates how suddenly spring 54 is unloaded, and thus, how great of a force is applied by punch 50 during shearing.

Figure 8:
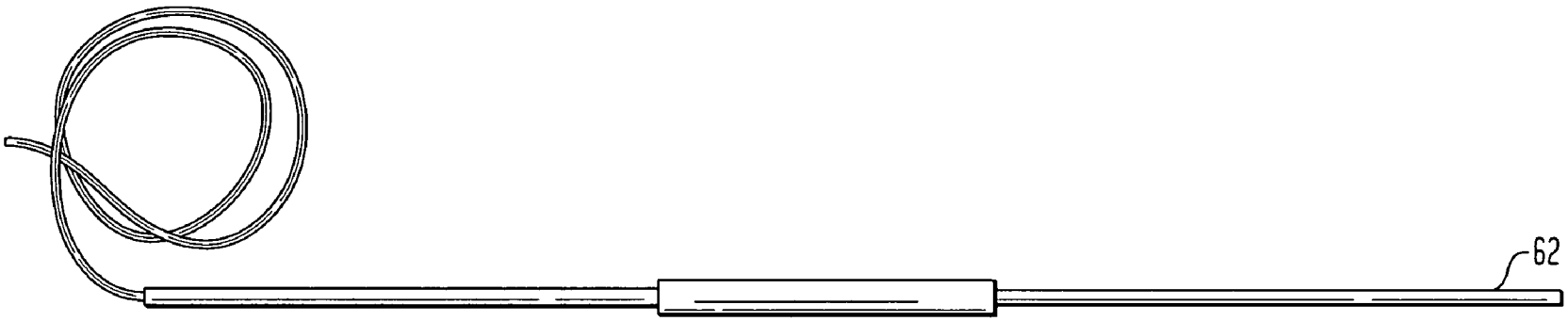
FIG. 8 is a top perspective view of a heated roller core from the tabbed divider making apparatus shown in FIG. 2.

Once provided with the sheared portion of folded film 31, the sheet of paper stock is preferably fed through a series of opposed heated rollers in order to at least partially melt film 31, thereby laminating the portion of paper stock which ultimately becomes the tab. Of course, film 31 may alternatively be attached to the paper stock through adhesive or the like. In the figures, machine 20 is shown as having two sets of opposed heated roller pairs 33 and 35, each pair having one heated roller above the next. Of course, any number of heated rollers may be employed. Heated rollers according to the present invention may include a heating core 62, as shown in FIG. 8, which is surrounded by a rubber material similar in nature to that utilized in rollers 24 and 26. The use of a material such as rubber, once again, allows for some give between the opposed rollers, which in turn, prevents binding of paper stock fed therebetween. Heating core 62 is preferably connected with a power source and supplied with enough heat to transfer heat to at least the portion of the paper stock fed between heated roller pairs 33 and 35 such that the folded film 31 is laminated on the paper stock. As those of ordinary skill in the art would recognize, the amount of heat required in this lamination process will vary depending upon such factors as the type of film and paper stock being utilized, the thickness and type of rubber coating provided over heating core 62, and the speed at which machine 20 is operated, among others.

Notably, heating core 62 may be fixed with respect to machine 20 such that it is not rotated about its own axis. During the laminating process, a heated roller may then rotate about heating core 62. The heat provided by heating core 62 is emitted about its external surface, which does not require heating core 62 to be rotated during the laminating process.

Figure 5:
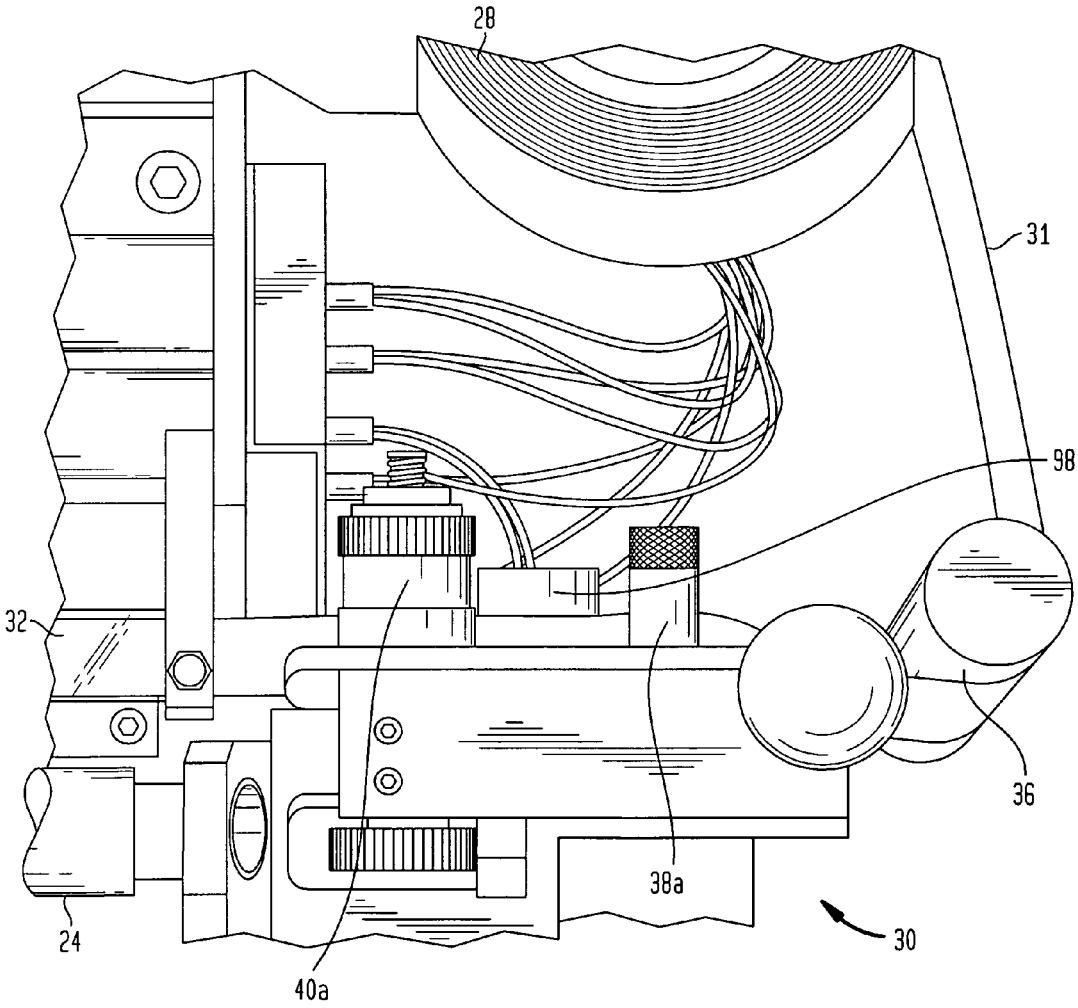
FIG. 5 is an enlarged top perspective view of a film director assembly of the tabbed divider making apparatus shown in FIG. 2.
Figure 6:
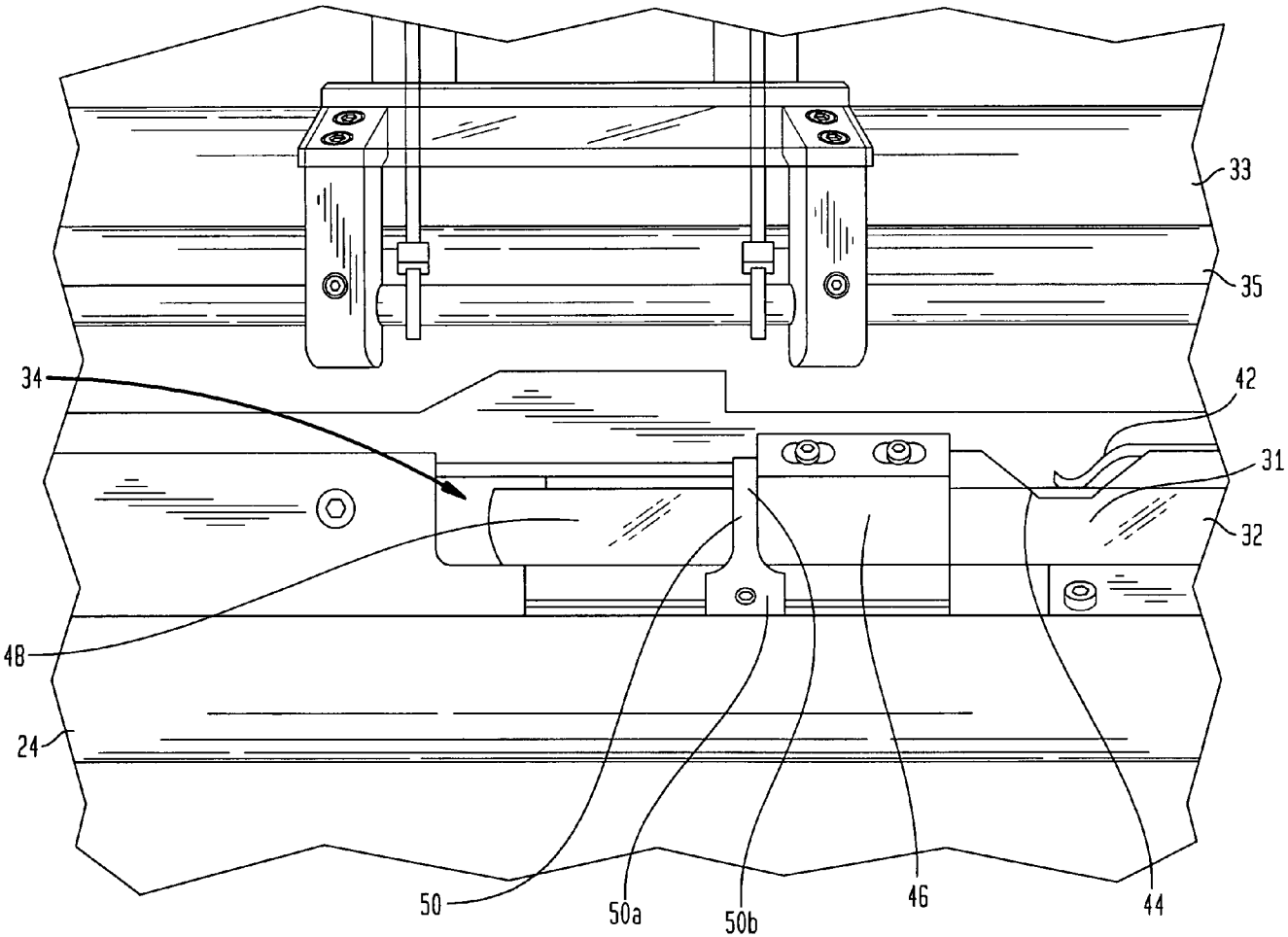
FIG. 6 is an enlarged top perspective view of a punch of the tabbed divider making apparatus shown in FIG. 2.

Heating core 62 preferably includes a heating element (not shown). This heating element is preferably disposed within the core and connected, via a connection, to a controller (not shown). As is best shown in FIG. 5, these connections are preferably wires. However, it is to be understood that these connections can be any one of many different types of connections, including wireless connections. Similarly, the heating element may be any one of many different types of heating elements, including a cartridge heater. The controller preferably acts to measure the temperature being provided by heating core 62 to a sheet of paper stock being processed by machine 20, and may vary such temperature according to operator instructions and/or an embedded machine program. In this regard, it is to be understood that, although not shown, several temperature reading elements (e.g., thermometers) may be provided within machine 20 to measure the temperature being provided to the sheet of paper stock by the individual rollers. The actual temperature of the paper stock may also be measured. Those of ordinary skill in the art would readily recognize the many different controllers which may be provided to properly control the temperature output of heating core 62.

Figure 9:
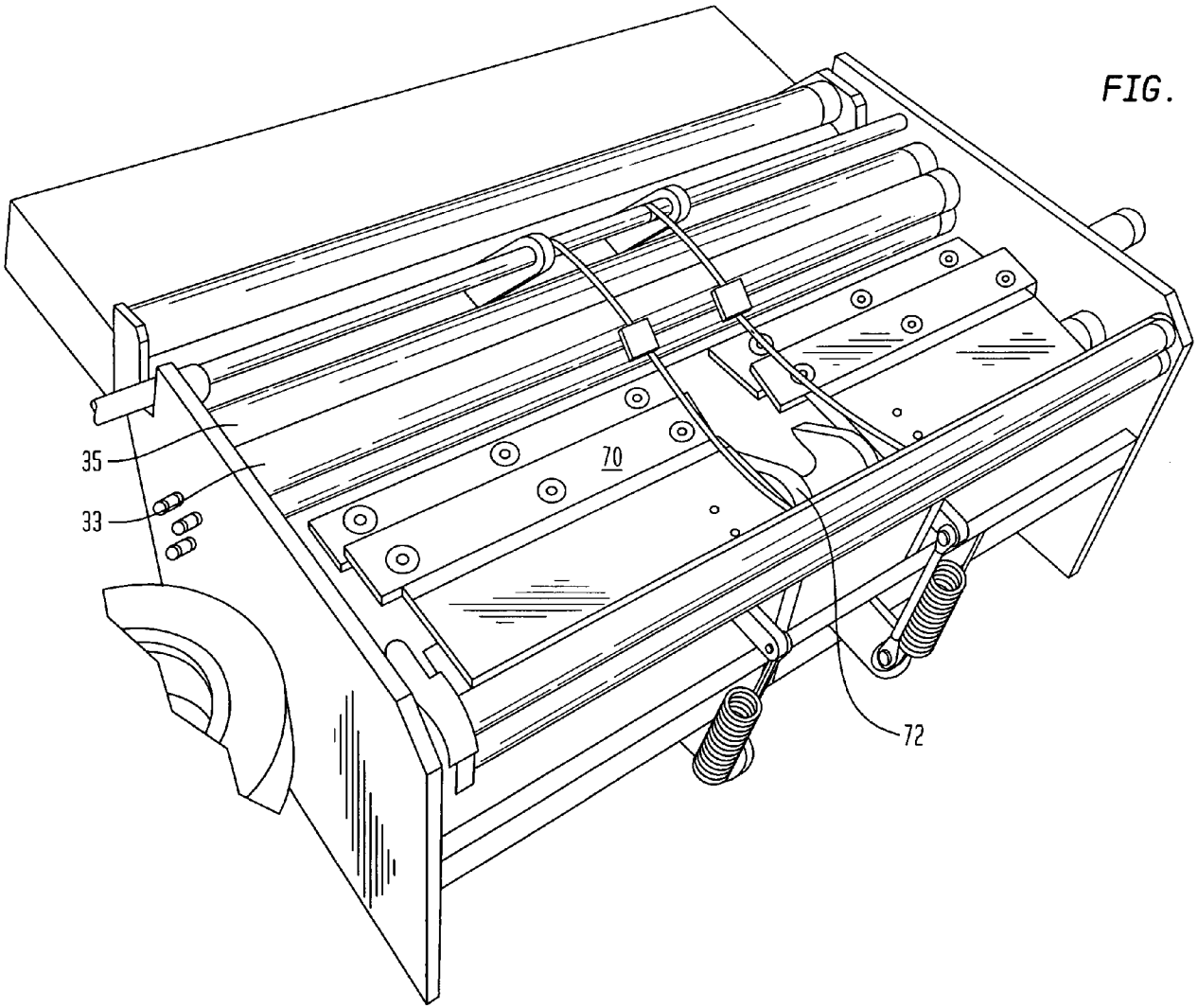
FIG. 9 is a rear perspective view of the tabbed divider making apparatus shown in FIG. 2.

Subsequent to passing between heated roller pairs 33 and 35, the sheet of at least partially-laminated paper stock is fed into a processing section that includes a knife package unit 70 (best shown in FIG. 9). Knife package unit 70 shears the sheet of paper stock along its laminated edge in order to cut away certain portions of the paper stock, thereby forming the tab. More specifically, knife package unit 70 is shown as a standard shear having a cut-out 72 that corresponds to the intended tabbed portion of the paper stock. Those of ordinary skill in the art would recognize the many alternative shear structure designs that may be utilized with the present invention. Ultimately, depending upon the position of the sheet of paper stock, a divider can be created having tabs, such as tabs 12*a*-12*e* of dividers 10*a*-10*e* shown in FIGS. 1A-E. In other words, the positioning of a sheet of paper stock entering knife package unit 70 will dictate where the tabbed portion will be located with respect to the rest of the sheet.

To achieve an overall reduced size of machine 20, one aspect of the present invention provides a unique shearing mechanism. Whereas prior devices often utilize direct motor power in conjunction with the force of gravity acting on the their relatively heavy shears in order to shear the paper stock, the present invention utilizes a system much like the one discussed above described with respect to punch 50 and the shearing of film 31. As is shown in FIGS. 10-14, knife package unit 70 employs a cam and spring mechanical design. More particularly, machine 20 includes a pair of springs 74 (best shown in FIG. 10), a pair of struts 76 (best shown in FIG. 10), and an oblong-shaped cam 78 (best shown in FIG. 13) situated on an axle 80. Springs 74 are each connected at one end to a portion of carriage 22, and at the other end to a pivotable arm 82. Each arm 82 is fixedly connected to axle 80 such that arms 82 rotate along with axle 80. Arms 82 are connected via axle 80 with struts 76, which are, in turn, connected with knife package unit 70. At one end, axle 80 is fixedly connected to an extension 86 which thusly rotates along with axle 80. Extension 86 further includes a rounded surface 84.

Figure 10:
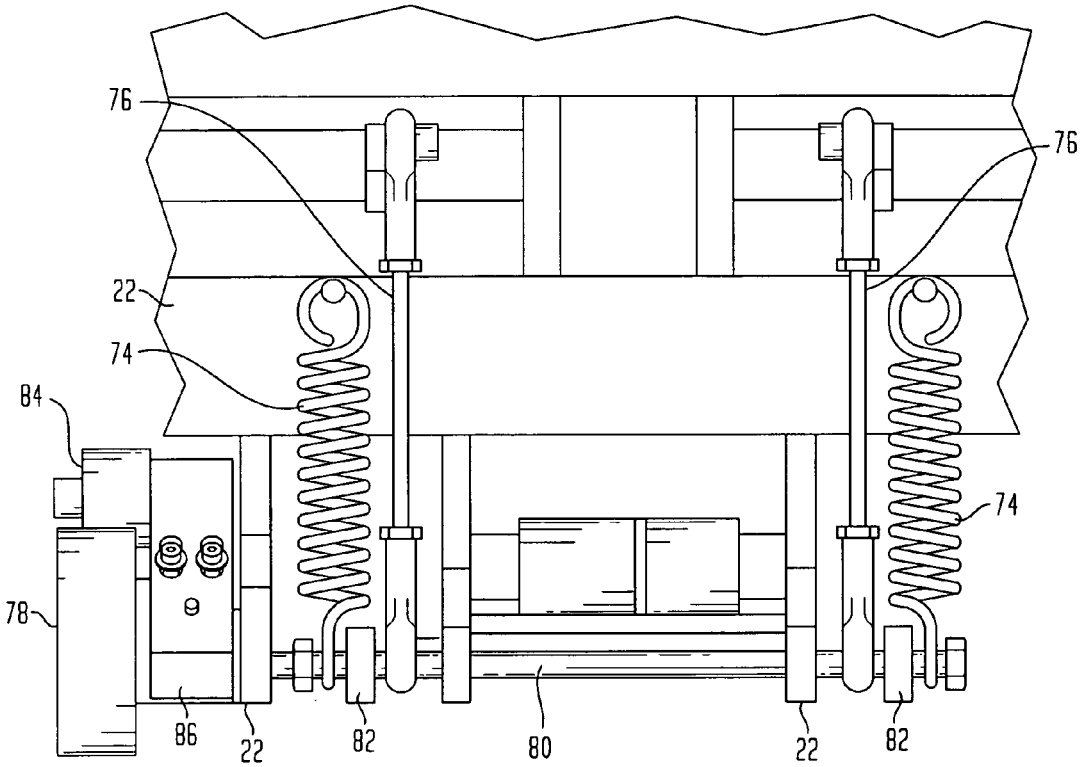
FIG. 10 is an enlarged rear perspective view of an actuator portion for the knife package of the tabbed divider making apparatus shown in FIG. 2.
Figure 11:
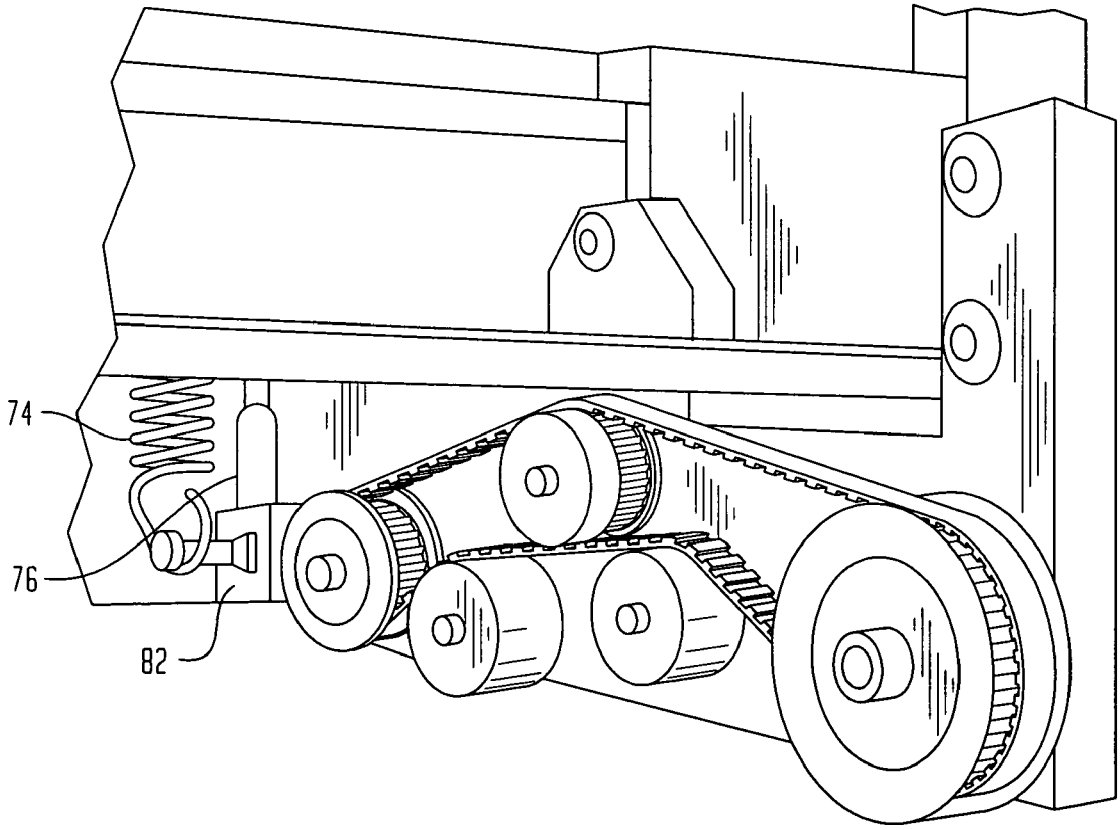
FIG. 11 is an enlarged view of a portion of the actuator portion of FIG. 10.
Figure 12:
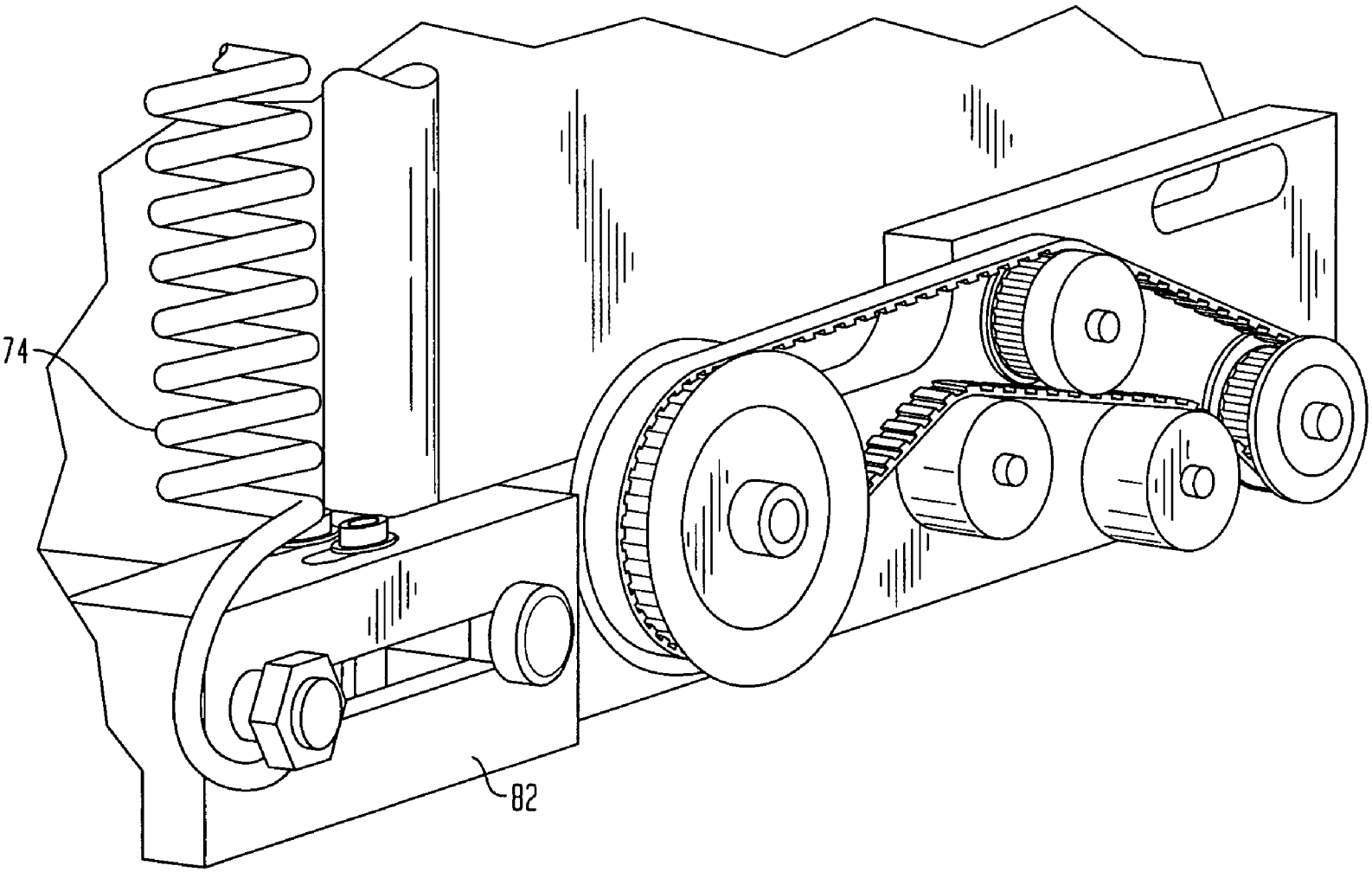
FIG. 12 is another enlarged view of the portion of the actuator portion shown in FIG. 11.
Figure 13:
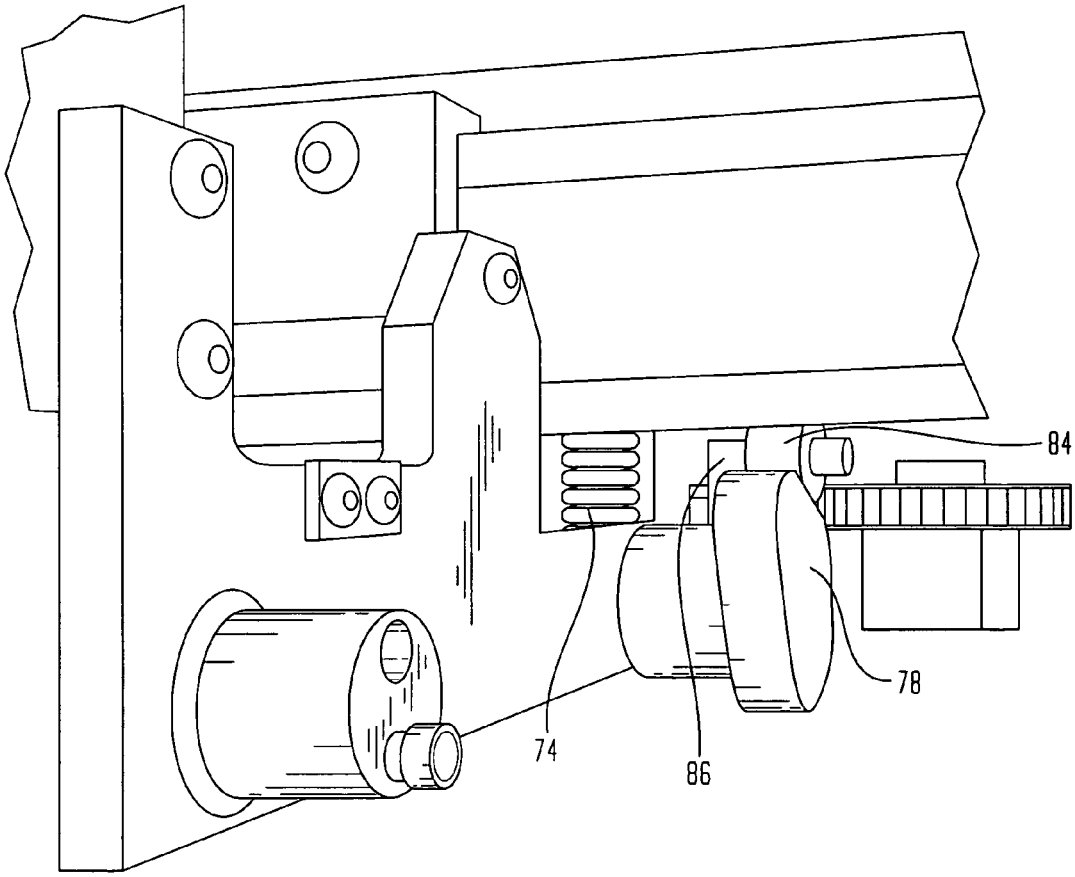
FIG. 13 is another enlarged view of another portion of the actuator portion shown in FIG. 10.
Figure 14:
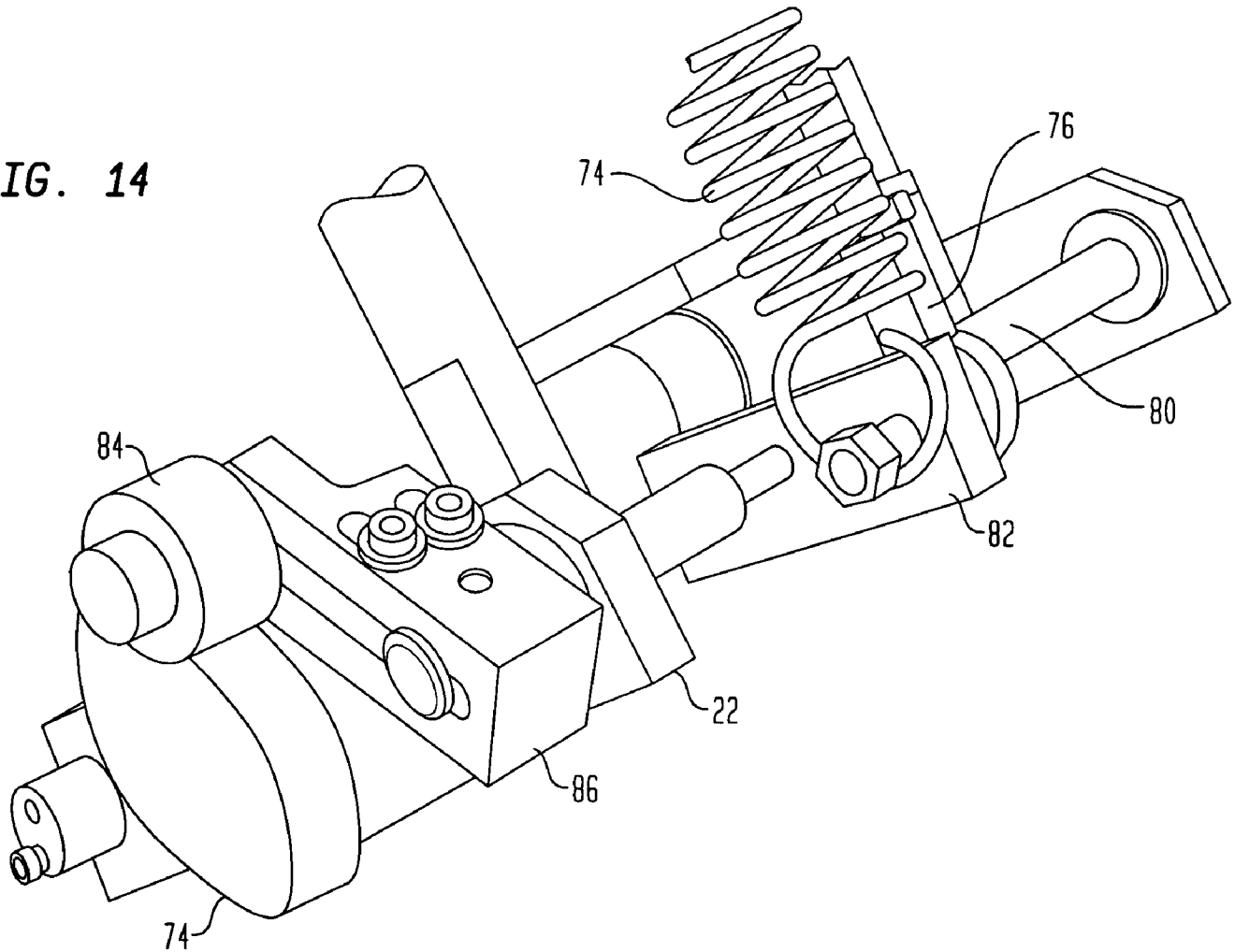
FIG. 14 is another enlarged view of the portion of the actuator portion shown in FIG. 13.
Figure 15:
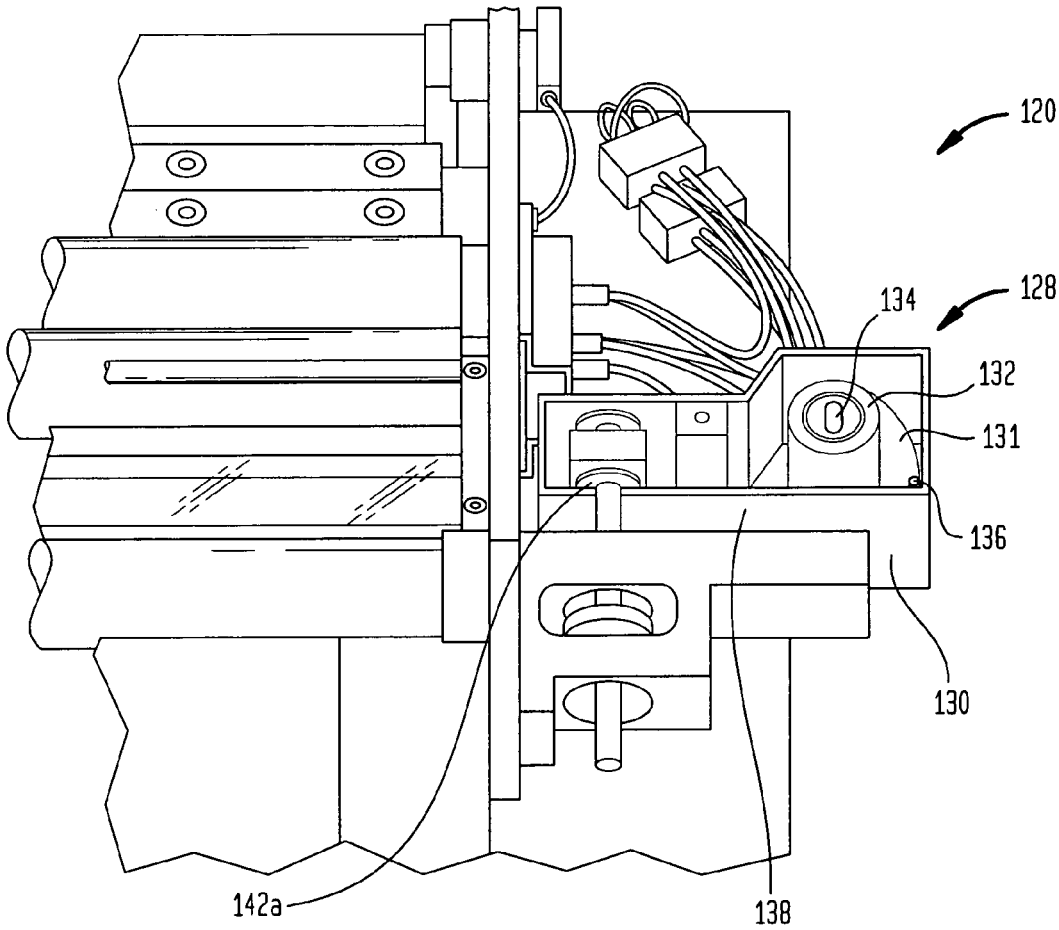
FIG. 15 is a top perspective view of a film module shown in conjunction with a tabbed divider making apparatus according to another embodiment of the present invention.
Figure 16:
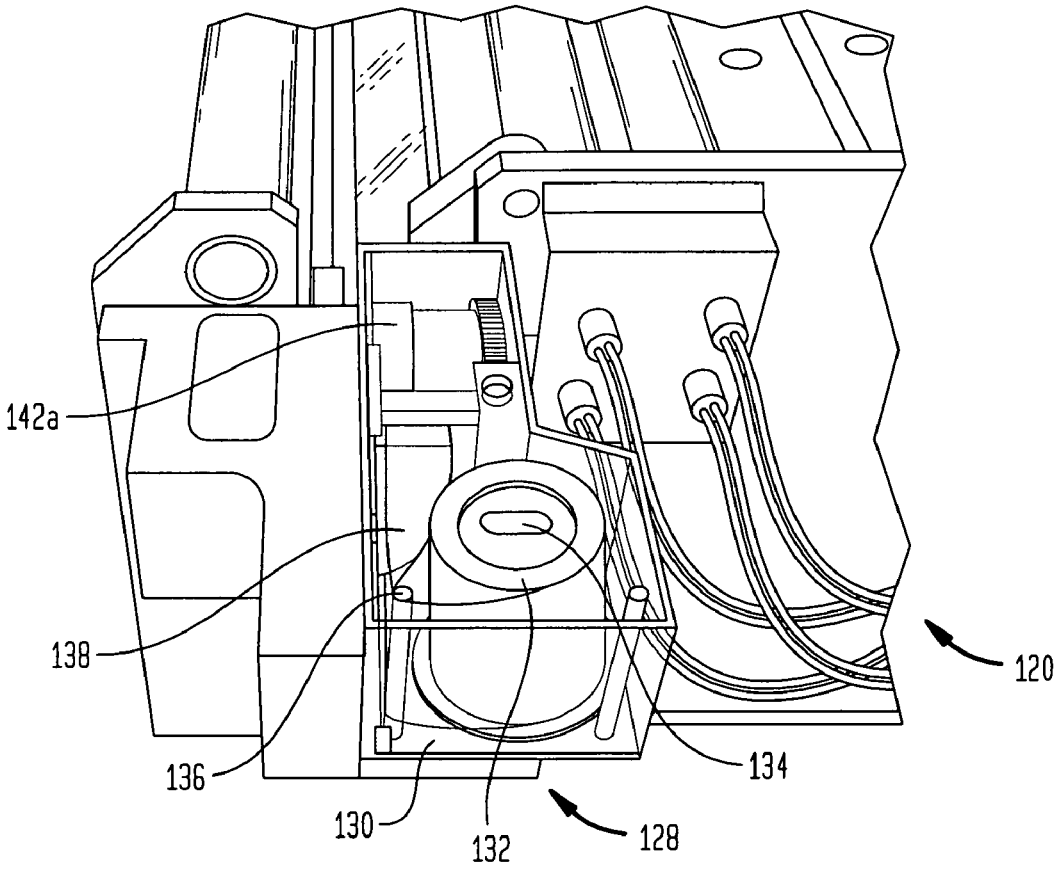
FIG. 16 is a right side perspective view of the film module shown in FIG. 15.
Figure 17:
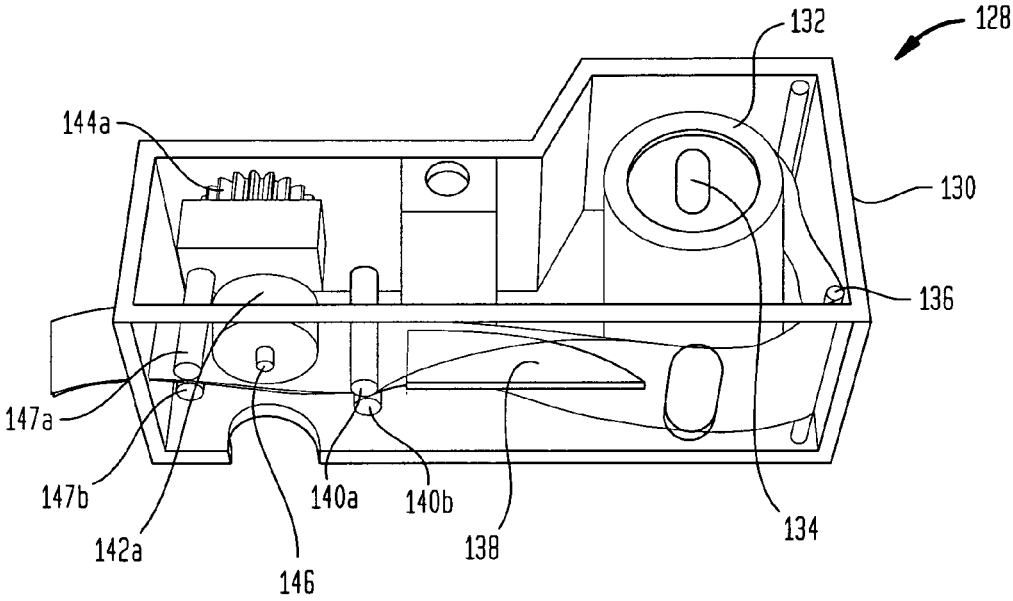
FIG. 17 is an enlarged top perspective view of the film module shown in FIG. 15 shown removed from the tabbed divider making apparatus.
Figure 18:
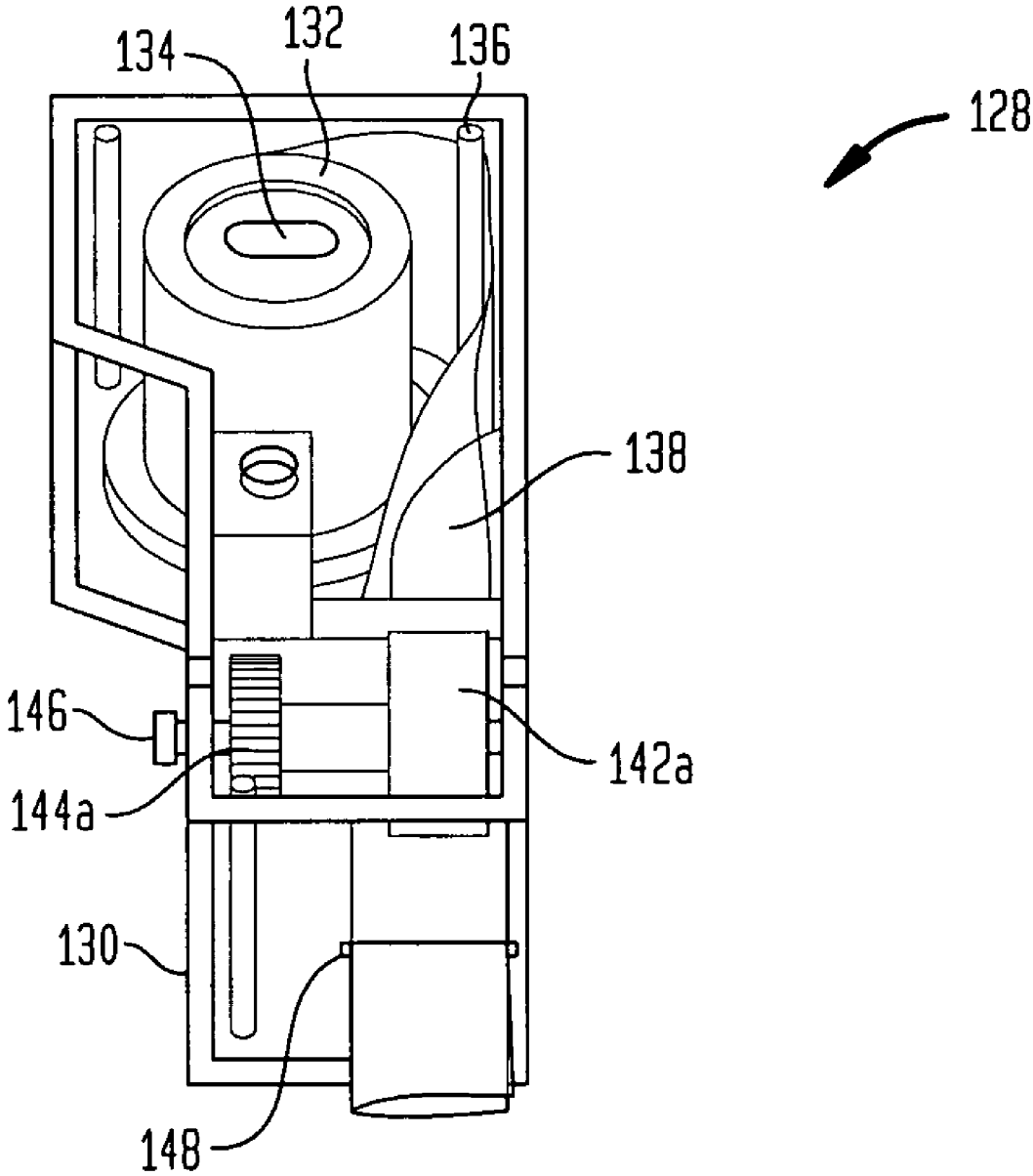
FIG. 18 is an enlarged left side perspective view of the film module shown in FIG. 17.

In operation, rotation of cam 78 and axle 80 causes different portions of cam 78 to make contact with rounded surface 84. Cam 78 may be rotated such that the rounded portion of the circumference of cam 78 makes contact with rounded surface 84, driving rounded surface 84 and thusly rotating extension 86. This movement forces extension 86 to rotate axle 80, which in turn rotates arms 82 in a downward direction (as shown in FIG. 10), thereby causing loading of springs 74. Further, when cam 78 is rotated such that the flat portion of its circumference comes into contact with rounded surface 84, the aforementioned mechanical connection allows arms 82 to be rotated upward through the unloading of springs 74. This, by means of the connection between arms 82 and knife package 70 provided by struts 76, causes actuation of knife package 70. In other words, the force provided by springs 74 translates into the shearing of paper stock by knife package 70. The configuration and interaction of cam 78 with the surrounding components is similar in nature to cam 52 with respect to punch 50, discussed in detail above. It is noted that in certain embodiments, such as machine 20 depicted in the figures, arms 82 may include alternative or additional components that may allow for smoother and more continuous operation thereof.

It will be understood that the components associated with the operation of knife package 70 are rigid. Therefore, although cam 78 is positioned to one side of axle 80, the operation of cam 78 rotates the entirety of axle 80. Each of springs 74 is thusly loaded to substantially the same length.

After machine 20 has performed the above-described steps, the sheet of paper stock has essentially become a divider having a laminated tabbed portion. Examples of these dividers are shown in FIGS. 1A-1E and discussed above. Preferably, these dividers enter the final portion of machine 20, which is designed to store, and may additionally collate, the finished dividers. Rollers 90 and 92 are preferably included just downstream of knife package 70, with respect to the flow of paper stock in machine 20. Rollers 90 and 92 are provided to pull the finished paper stock into the final portion of machine 20. Although not shown in the figures, this portion may take the form of an output tray or the like, as is known in the art. For example, one suitable output tray is designated with reference number 26 in the '830 provisional and the '828 application, and such could be incorporated into the present invention. Of course, such may have to be modified to fit the specific dimensions of machine 20 as described above.

Machine 20 preferably provides for an automated control of the entire process as described above. Very little, if any, manual operation is required by an operator. In fact, machine 20 is preferably associated with a computer program or the like so that the desired type and amount of dividers can be inputted by a user through the use of a keyboard or a touch-screen type of device. Thereafter, a user can simply provide machine 20 with the necessary paper stock and film material, and machine 20 can create the tabbed dividers accordingly. Of course, in machines in accordance with the present invention that include a printer or the like, the user may also input the information to be printed on the tabs.

The various components of machine 20 have been described above in relation to their operation. It is to be understood that each of these components is preferably mechanically interconnected with other of the components so as to ensure synchronous operation of machine 20. For example, as is best shown in FIG. 3, machine 20 is preferably provided with one or more motors 94 which powers a drive train including a chain linkage 96. This motor 94 and linkage 96 system allows for a single motor to power multiple components, such as the various rollers, through interconnection with one or more necessary gears and/or belts (not individually numbered or discussed) associated with the system. In addition, this system allows for each of these components to rotate at the same rate and/or at the same time, in order to ensure that the necessary synchronization of machine 20 is provided for proper operation. Likewise, punch 50 and knife package 70 may also be controlled by this single motor 94 and linkage 96, through the use of additional intermediate gears and/or belts. The use of a single motor 94 for this operation reduces the manufacturing cost and overall weight of machine 20. Of course, more than one motor may be utilized. For instance, as is shown in FIG. 4, a second motor 98 may be utilized to provide power to the components that pull film 31 from roll 28. Those of ordinary skill in the art would recognize the limitless possibilities which could be developed and provided to machine 20 in order to achieve the desired operation of same.

In a preferred embodiment of the present invention, machine 20 is approximately between 20 and 30, and preferably 27, inches wide to allow for many differently sized dividers to be created. All of this can preferably be done without having to reposition paper stock once it is loaded into machine 20. A preferred machine is capable of producing sets of tabbed dividers at a rate of approximately 300-1200 dividers per hour. All of this can be done with minimal input and under low supervision of an operator. In addition, the automated aspect of machine 20 ensures accuracy and precision during repeated use.

FIGS. 15-18 depict a film module or cartridge 128 for providing tube or channel 32 with film 131 in accordance with another embodiment of the present invention, namely machine 120. Film module 128 has a body portion 130 made of a substantially clear material, such as plexiglass. However, those of ordinary skill in the art would recognize that any material may be utilized in forming body portion 130, including non-transparent materials. The transparent nature of body portion 130, as shown in the figures, preferably allows for easier monitoring of the amount and proper orientation of film 131 in module 128. The composition of body portion 130 should be such that it can withstand the higher temperatures associated with the operation of machine 120.

Within body portion 130 is a roll of film 132 similar to roll 28 discussed above. Preferably for the sake of space preservation and portability of machine 120, roll 132 is smaller than roll 28, although different sizes of roll 132 may be utilized. Roll 132 is preferably situated on a post 134 or the like, which allows for the free rotation of roll 132. Again, this is similar to the situation discussed above with respect to roll 28. Film 131 from roll 132 is preferably fed around a second post 136 which essentially orients the film in a direction conducive for feeding same through tube or channel 32. Thus, the function of a majority of the components which make up film director 30, as discussed above, is similar to those of module 128.

Once oriented in the proper direction by second post 136, film 131 from roll 132 engages a rounded finger 138 which acts to place a crease or fold in film 131. Rounded finger 138 need not actually crease film 131, but may alternatively bias film 131 such that it is prepared oriented to be folded when passed through subsequent portions of film module 128. The single piece of film 131 is folded such that its outer edges are directed towards one another after engagement with finger 138, essentially folding film 131 in half. Film 131 then passes through two opposed creasing extensions 140*a* and 140*b* (best shown in FIG. 17) that further crease or fold the film material. As is discussed above, film 131 is maintained in this configuration throughout tube or channel 32. With regard to above-described machine 20, similarly positioned rollers 142*a* (best shown in FIG. 17) and 142*b* (not shown) are disposed above and beneath film 131, respectively, and pull film 131 from roll 128 through the aforementioned components of film module 128. According to the figures, roller 142*a* is a component of film module 128, while roller 142*b* is a component of machine 120. Either or both of rollers 142*a* and 142*b* may be spring-loaded such that they are biased toward each other. This bias maintains contact between film 131 and rollers 142*a* and 142*b*, which may also be configured to frictionally grip film 131. Each of rollers 142*a* and 142*b* may be provided with one or more gears, such as gear 144*a* corresponding to roller 142*a*, that ensure that the associated rollers move in synchronization with one another. Further, roller 142*a* may be provided with an extension 146 which engages one of the powered portions of machine 120 in order to derive the motion necessary to rotate rollers 142*a* and 142*b*. Due to the direct connection between roller 142*b* and machine 120, roller 142*b* may also or alternatively be driven through an extension or similar means. The aforementioned gear assembly ensures that motion provided to roller 142*b* is also provided to roller 142*a*.

Although roller 142*a* is described as being a component of film module 128 and roller 142*b* is described as being a component of machine 120, rollers 142*a* and 142*b* may both be components of machine 120. Alternatively, both of rollers 142*a* and 142*b* may be components of film module 128. Regardless of the configuration of rollers 142*a* and 142*b*, body 130 is preferably designed such that when film module 128 is inserted into machine 120, rollers 142*a* and 142*b* are positioned adjacent to film 131 such that each contacts film 131 in the above-described manner.

Module 128 further includes additional creasing extensions 147*a* and 147*b* that may further fold and/or press film 131. A slot 148 formed in body portion 130 allows for the folded film 131 to pass from module 128 into tube or channel 28. Thus, film module 128 is a self-contained and removable/exchangeable means for providing film material to machine 120. It is to be understood that the specific design of module 128 can vary, as those of ordinary skill in the art would recognize. Furthermore, it is also to be understood that module 128 could be exchanged with other cartridge designs, such as one similar to that disclosed in the '830 provisional and the '828 application. Those of ordinary skill in the art would also recognize how such could be incorporated into the machine.

Figure 19:
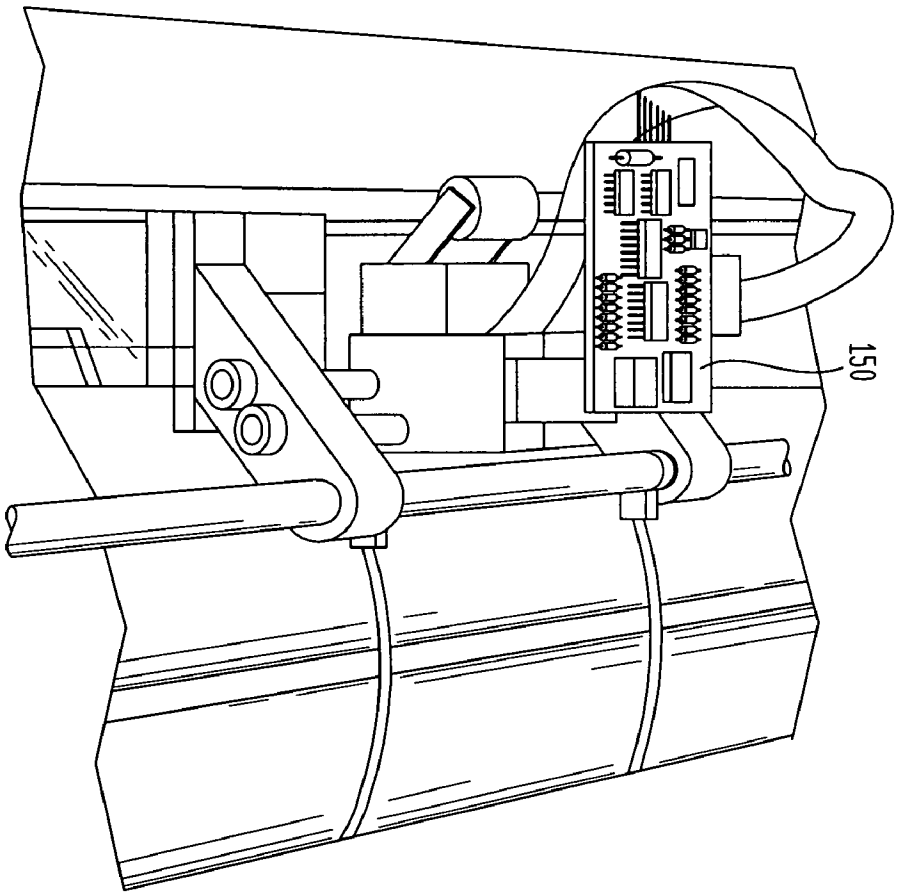
FIG. 19 is a right side perspective view of a printing assembly that can be used in conjunction with any of the tabbed divider making apparatus of the present invention.
Figure 20:
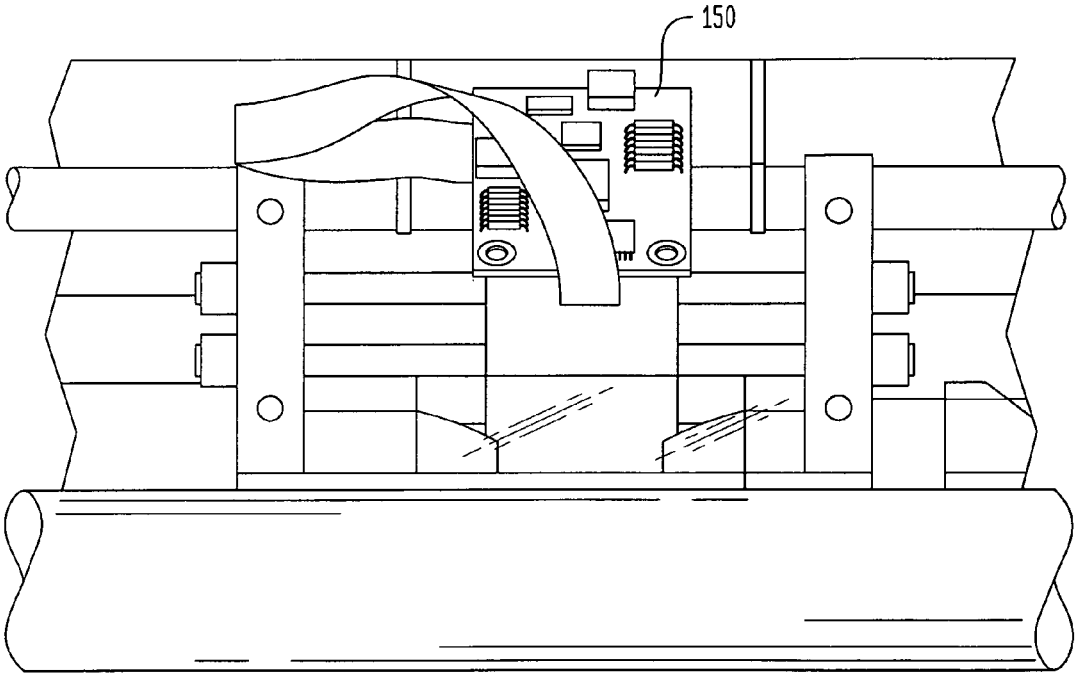
FIG. 20 is a top perspective view of the printing assembly shown in FIG. 19.
Figure 21:
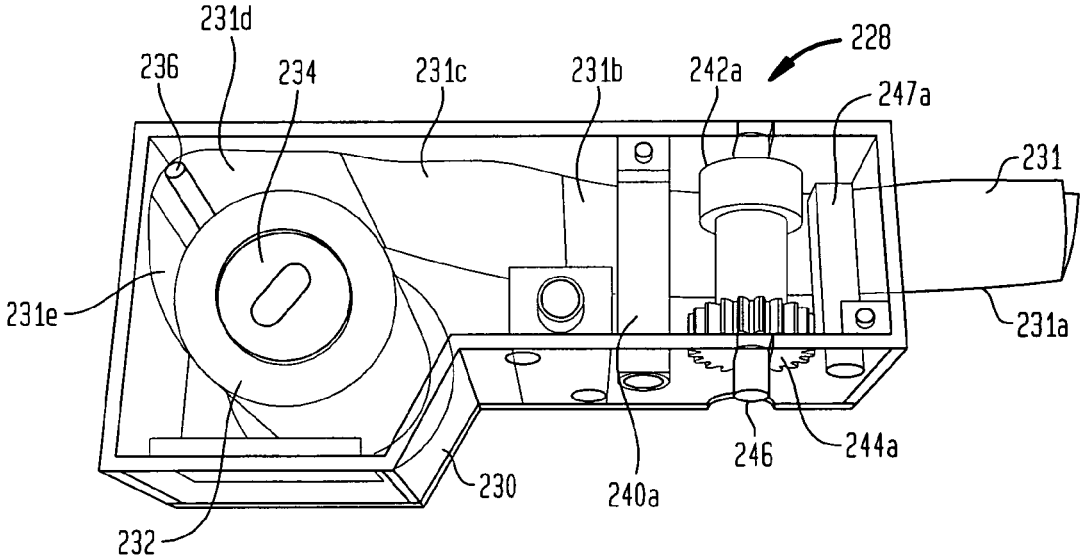
FIG. 21 is a top/rear perspective view of another embodiment of the film module shown in FIG. 15.
Figure 22:
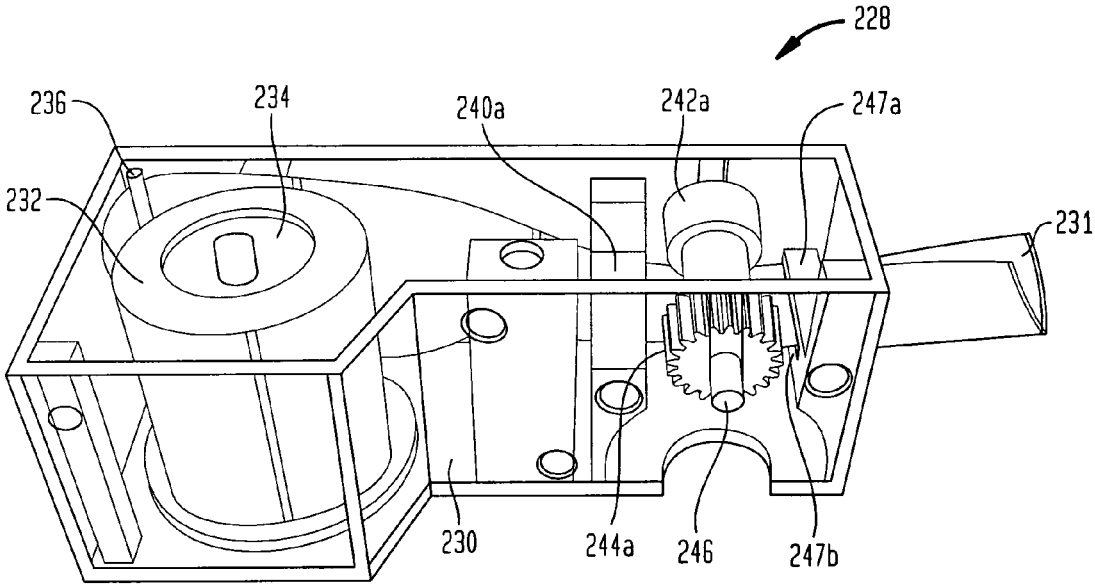
FIG. 22 is a rear perspective view of the film module shown in FIG. 15.
Figure 23:
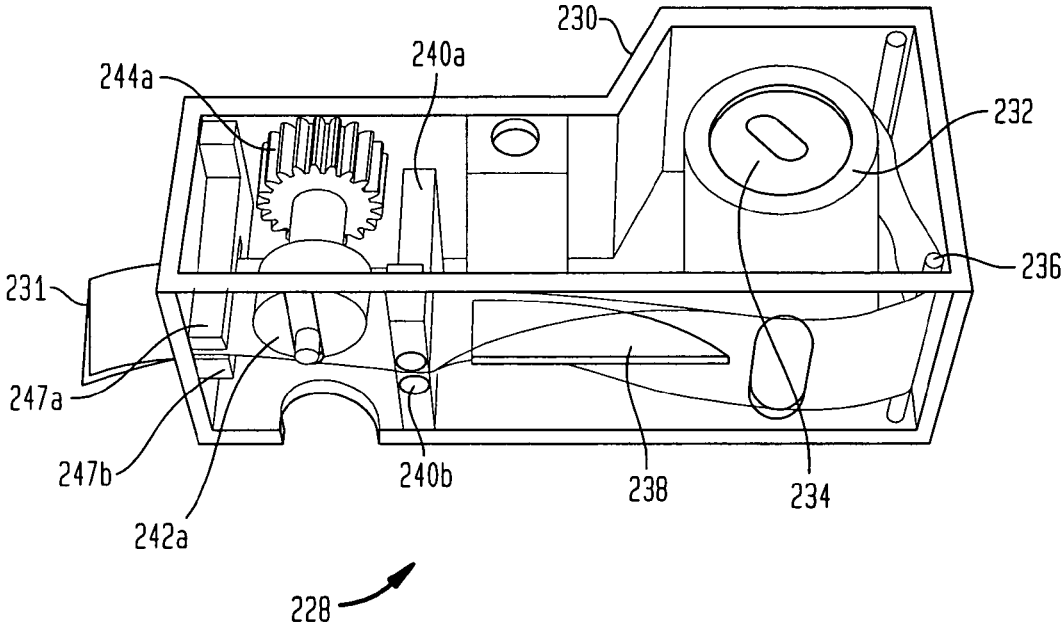
FIG. 23 is a front perspective view of the film module shown in FIG. 15.
Figure 24:
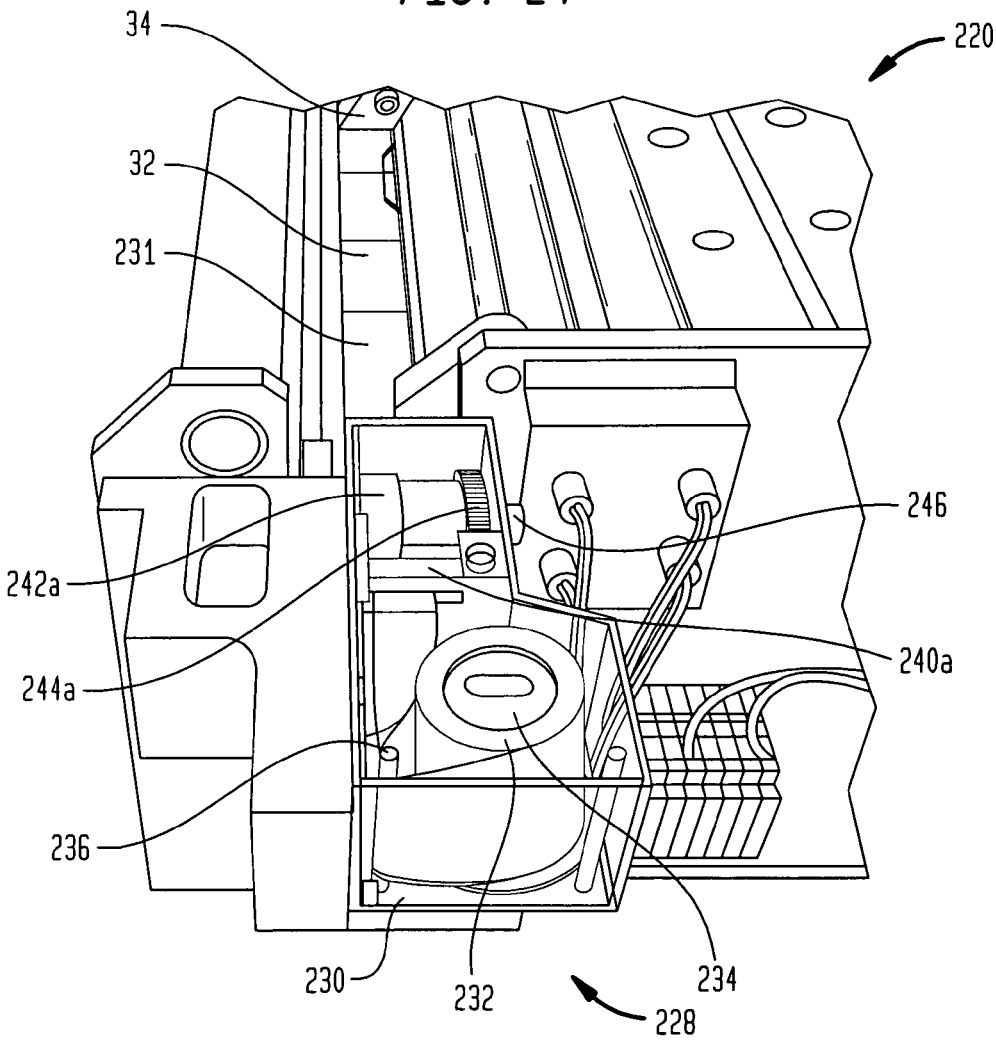
FIGS. 24-27 are various perspective views of the film module shown in FIG. 15 in conjunction with a tabbed divider making apparatus according to another embodiment of the present invention.
Figure 25:
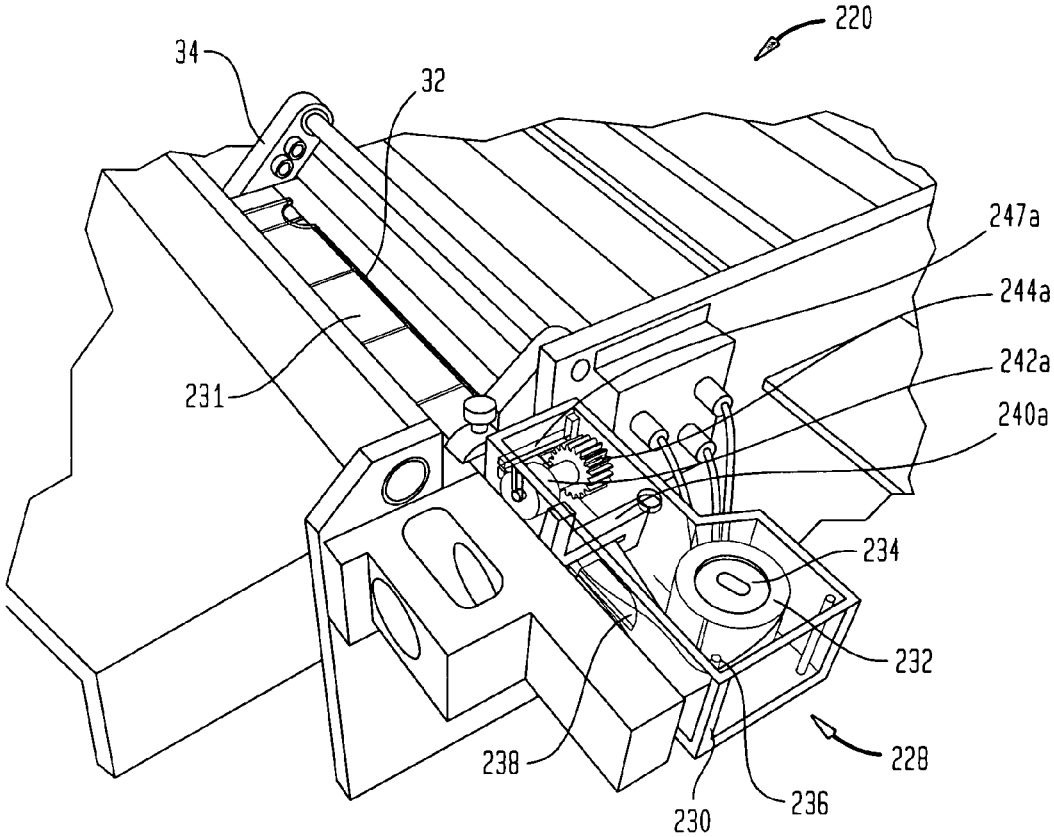
Figure 26:
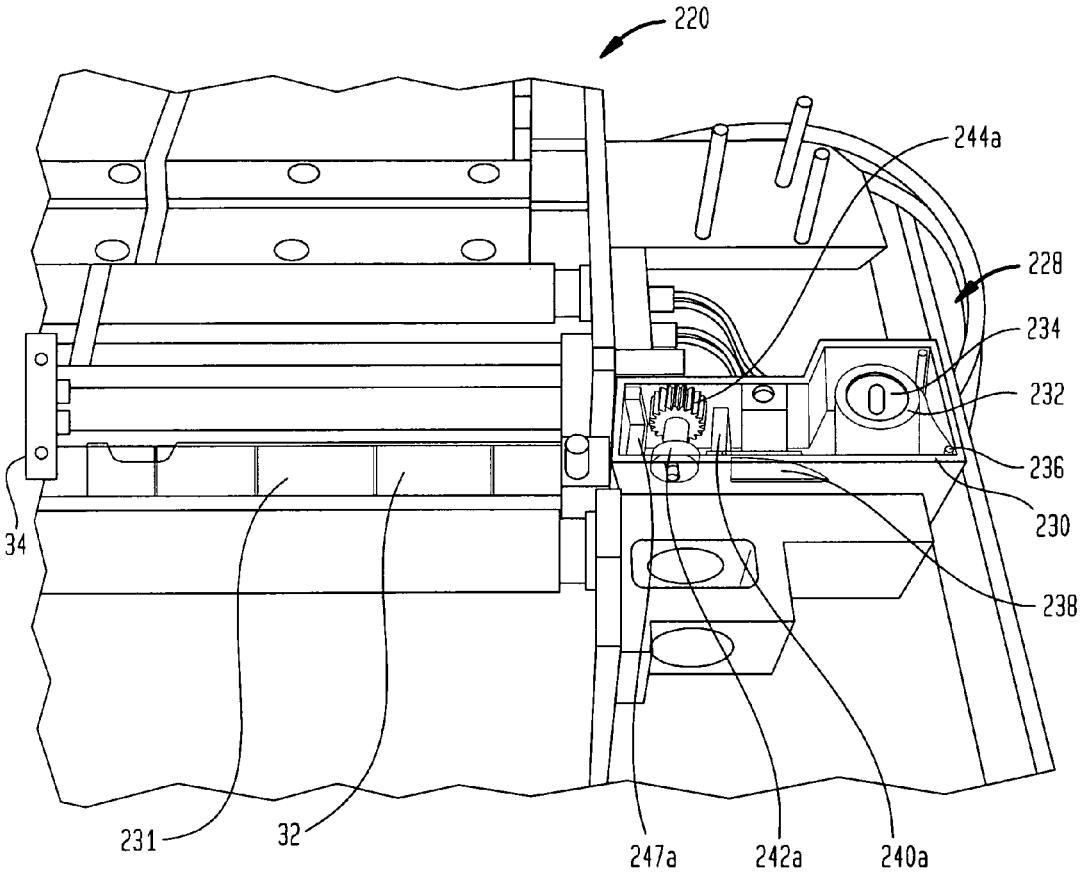
Figure 27:
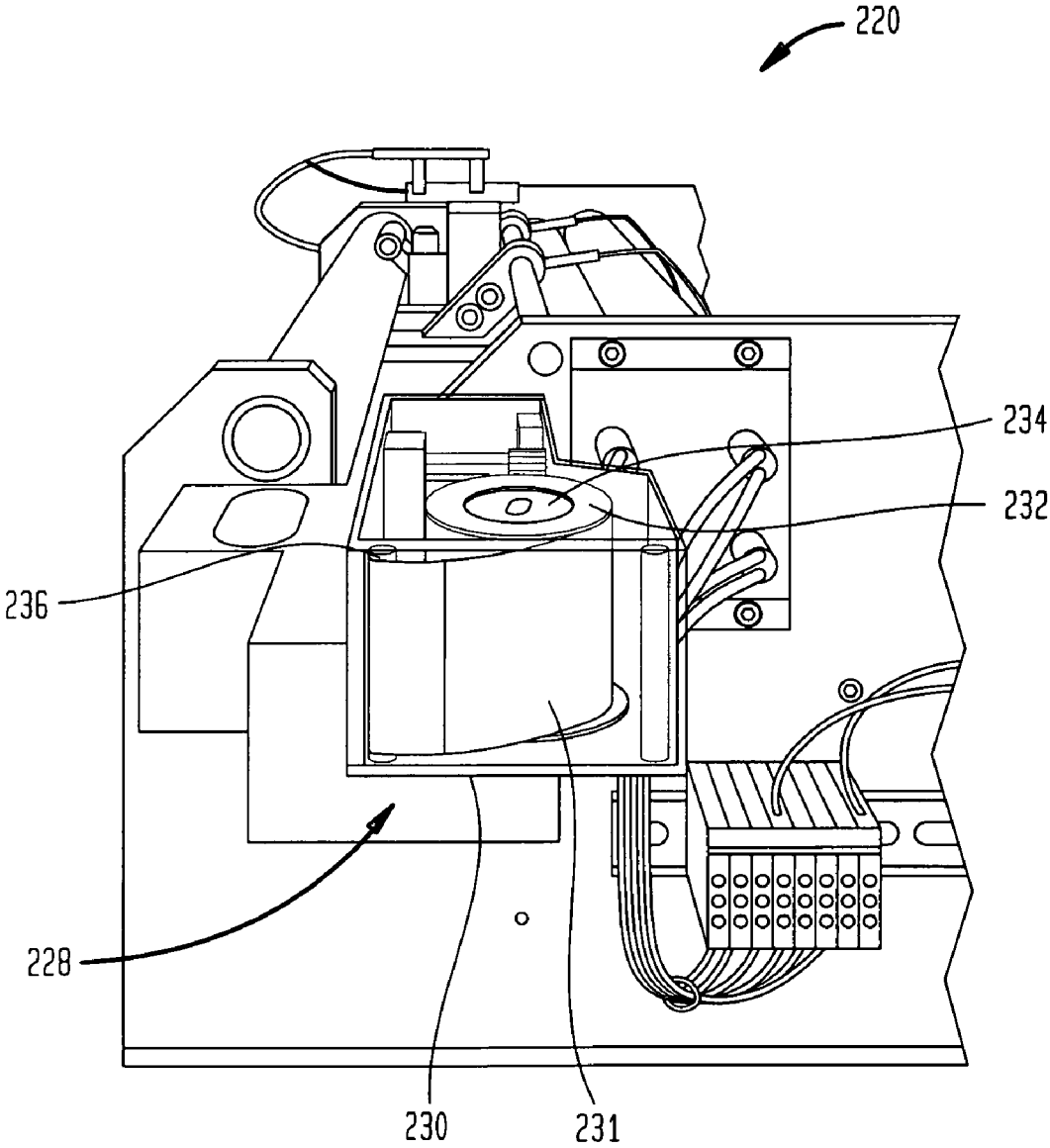

FIGS. 19 and 20 depict a printing assembly 150 that can be incorporated into machine 20 in accordance with the embodiments set forth herein. The specific printing assembly 150 shown in the drawings is manufactured by Paralax, Inc. under the model designation Basic Stamp. This model is an inkjet type printer and preferably provides user-inputted indicia to the portion of the paper stock which will ultimately be formed into a tab. Preferably, the paper stock is printed prior to the lamination of film material onto the edge of the paper stock. Alternatively, the printer could be designed to print directly on the film material. Although one specific printer design is described and shown in the drawings, it is to be understood that other printing assemblies could be utilized. For example, as opposed to an inkjet printing system, a laser printing system could be incorporated into the design of machine 20. Preferably, machine 20 is designed so that the printing of indicia on the tab portion is performed in accordance with the above-discussed automated features of the machine.

FIGS. 21-27 depict film module 228, another embodiment of the above-described film module 128, which is included in another embodiment of the present invention, namely machine 220. The components of film module 228 are similar in nature to those of film module 128, with like elements being labeled with like numerals, but within the 200-series of numbers. One difference between the two embodiments is that film module 228 includes only one film roller 242*a* for advancing film 231 toward shearing portion 34 of machine 220. Film roller 242*a* is preferably equipped with an outer portion that frictionally engages the folded film 231 in order to advance same toward shearing portion 34. It is noted that slot 248 is present in film module 228, but is not shown in FIGS. 21-27.

Film 231 is shown as being multicolored, as opposed to being comprised of a single color like that of the aforementioned embodiments. The junction between respective colored sections 231*a-e* (shown in FIG. 21) can be taken into account so that shearing portion 34 cuts film 231 along such junctions. In this way, machine 220 may be programmed or operated to produce a set of tabbed dividers having differently colored tabs. Of course, any number of different colors can be provided on roll 232 of film 231.

The film material utilized with any embodiment of the present invention may be heat-sensitive or pressure-sensitive, and may include various types of adhesive or the like. Further, an adhesive material may be sprayed or otherwise applied to the paper stock, such as via one or more brushes or rollers, in order to provide a binding connection between the film material and the paper stock.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A tabbed divider making apparatus capable of making tabbed dividers from at least one sheet of paper, the apparatus comprising:

a feeder for providing at, least one sheet of paper to the apparatus;

a film provider for providing film to the at least one sheet of paper traveling through the apparatus;

a film shearing portion having at least one first spring and a punch actuated by the at least one first spring;

a knife package for shearing a portion of the at least one sheet of paper to create a tab;

at least one strut attached to the knife package;

a pivotable arm attached to the at least one strut;

at least one second spring attached to the pivotable arm, the at least one second spring having a loaded position and an unloaded position; and a cam having an oblong shape;

wherein rotation of the cam causes movement of the at least one second spring between the loaded position and the unloaded position and movement of the at least one second spring from the loaded position to the unloaded position causes the knife package to shear the portion of the at least one sheet of paper, and wherein the film provider further includes a removable cartridge having a roll of film, the cartridge including a housing including an opening through which the film is passed to the film shearing portion, one or more rollers disposed within the housing for advancing the film, a creasing finger disposed within the housing for providing a crease in the film, and two or more opposed extensions disposed within the housing for folding the film along the crease.

2. The tabbed divider making apparatus of claim 1, further comprising at least two opposed rollers configured to pull a sheet of paper from the feeder.

3. The tabbed divider making apparatus of claim 2, wherein the at least two opposed rollers each include a rubber outer portion.

4. The tabbed divider making apparatus of claim 1, wherein the film is cut by a tip die.

5. The tabbed divider making apparatus of claim 4, further comprising a projection to align the film prior to its being cut by the tip die.

6. The tabbed divider making apparatus of claim 1, further comprising a laminating portion having at least one heated roller.

7. The tabbed divider making apparatus of claim 6, wherein the at least one heated roller is capable of at least partially melting the film.

8. The tabbed divider making apparatus of claim 7, wherein the at least one heated roller includes an outer rubber coating and a heating core.

9. The tabbed divider making apparatus of claim 7, wherein the at least one heated roller includes a heating core, and the at least one heated roller rotates with respect to the apparatus and the heating core does not rotate with respect to the apparatus.

10. The tabbed divider making apparatus of claim 1, further comprising two second springs and two struts.

11. The tabbed divider making apparatus of claim 1, further comprising an aluminum frame.

12. The tabbed divider making apparatus of claim 1, further comprising an output tray.

13. The tabbed divider making apparatus of claim 1, wherein the knife package includes a standard shear and a cut-out corresponding to the dimensions of a tab.

14. The tabbed divider making apparatus of claim 1, further comprising a printer.

15. The tabbed divider making apparatus of claim 14, wherein the printer is an ink jet printer.

16. A method of producing a tabbed divider comprising:

feeding a sheet of paper into a tabbed divider making apparatus;

providing a removable cartridge having a roll of film from which at least a portion of the sheet of paper is provided with film, wherein the cartridge includes a housing including an opening through which the film is passed, one or more rollers disposed within the housing for advancing the film, a creasing finger disposed within the housing for providing a crease in the film, and two or more opposed extensions disposed within the housing for folding the film along the crease;

at least partially laminating the film onto the sheet of paper;

shearing a portion of the laminated sheet of paper to create a tabbed divider, the sheering step including rotating a cam having an oblong shape to cause first and second movements of an arm, the first movement of the arm causing loading of at least one spring and the second movement of the arm allowing for unloading of the at least one spring, the unloading forcing a knife package to shear the portion of the laminated sheet of paper; and outputting the tabbed divider from the apparatus.

17. The method of claim 16, wherein the step of shearing includes loading and unloading at least two springs.

18. The method of claim 16, wherein the step of providing includes shearing a portion of the film and providing the sheared portion of film to the sheet of paper.

19. The method of claim 18, further comprising folding the film prior to shearing a portion of the film.

20. The method of claim 16, further comprising printing on at least a portion of the sheet of paper.

21. The method of claim 20, wherein the step of printing is performed by an ink jet printer.

22. The method of claim 20, wherein the step of printing includes printing on at least a portion of the laminated portion of the sheet of paper.

23. The method of claim 16, wherein the step of laminating is performed by at least one heated roller.

* * * * *